US005576674A

United States Patent [19]

Jachowski

[11] Patent Number: 5,576,674

[45] Date of Patent: Nov. 19, 1996

[54] OPTIMUM, MULTIPLE SIGNAL PATH, MULTIPLE-MODE FILTERS AND METHOD FOR MAKING SAME

[75] Inventor: Douglas R. Jachowski, Maui, Hi.

[73] Assignee: Allen Telecom Group, Incorporated, Solon, Ohio

[21] Appl. No.: 406,119

[22] Filed: Mar. 17, 1995

[51] Int. Cl.[6] ..... H01P 1/208

[52] U.S. Cl. ..... 333/212; 333/219.1

[58] Field of Search ..... 333/202, 212, 333/219.1

[56] References Cited

U.S. PATENT DOCUMENTS

| | | | |
|---|---|---|---|
| 4,760,361 | 7/1988 | Kobayashi | 333/212 X |
| 5,083,102 | 1/1992 | Zaki | 333/202 X |

OTHER PUBLICATIONS

Cameron et al. "Asymmetric Realizations for Dual–Mode Bandpass Filters," *IEEE Transactions on Microwave Theory and Techniques,* vol. MTT–29, No. 1, Jan. 1981, pp. 51–58.

Atia et al. "New Types of Waveguide Bandpass Filters for Satellite Transponders," *COMSAT Technical Review,* vol. 1, No. 1, Fall 1971, pp. 21–43.

Accatino et al. "Design and Realization of Multiple–Coupled Dual Mode Waveguide Filters," *CSELT Rapporti Technici,* vol. IX, No. 6, Dec. 1981, pp. 605–611.

*Primary Examiner*—Benny Lee
*Assistant Examiner*—Justin P. Bettendorf
*Attorney, Agent, or Firm*—Laff, Whitesel, Conte & Saret, Ltd.

[57] ABSTRACT

A preferred realization of a frequency spectrum filter incorporating multiple signal paths is selected using a new design tool, a plot of resonator coupling coefficient values representing filter designs having equivalent signal transfer characteristics. The design plot is formed by first subjecting an initial matrix of resonator coupling coefficients, representing a particular filter design, to pre-multiplications by selected plane rotation matrices—which each have their respective rotation angles—and to post-multiplications by their transposes. Equations for the individual elements that form the resulting modified coupling coefficient matrix are then plotted over a range of one of the rotation angles. Examination of the result plot leads to a selection of a set of coupling values in observance of predetermined criteria. An optimum realization of the filter is then constructed by adjusting the physical resonator couplings so that they conform to the coupling values selected from the plot. Some preferred realizations of dual-mode bandpass filters, which have been designed using this technique, are described.

28 Claims, 9 Drawing Sheets

41
45°
31a
45°
42
45°
31b
11
1
2
ELECTRIC FIELD COMPONENTS FOR RESONATOR 21
34
90°
35
20
44
45°
32b
45°
43
45°
12
32a
3
4
ELECTRIC FIELD COMPONENTS FOR RESONATOR 22
37
90°
36
20
45
45°
33a
45°
46
45°
33b
13
5
6
ELECTRIC FIELD COMPONENTS FOR RESONATOR 23

OPTIMUM, MULTIPLE SIGNAL PATH, MULTIPLE-MODE FILTERS AND METHOD FOR MAKING SAME

FIELD OF THE INVENTION

This invention relates generally to frequency spectrum filters incorporating multiple signal paths from their input to their output ports and in particular to finding and constructing a preferred physical realization for such a filter with a given transfer characteristic, and is more particularly directed toward some types of realizations of multi-path dual-mode bandpass filters and methods for discovering their existence.

BACKGROUND OF THE INVENTION

Equipment as diverse as voice and data communication systems, television, radio, radar, medical imaging systems, video cameras and telescopes require filters for signal processing. The technologies used to physically realize these filters are equally diverse: passive and active components, integrated and superconductive circuits, and coupled resonant cavities. The technology of choice depends on the applications requirements and on the portion of the frequency spectrum which is of interest, such as audio, microwave, or optical.

Regardless of the filter technology, the perpetual challenge in filter design is to improve filter efficiency through improvements to filter electrical, or optical, and environmental performance, and through reductions to filter size and cost. Incorporating multiple signal paths from the input port to the output port of a filter is known as an important means of improving filter efficiency.

There are also various well-known methodologies for designing such multi-path filters to satisfy pre-determined transfer characteristic requirements. One such method is to develop a normalized coupling coefficient matrix for a single symmetric canonical filter realization, where the coupling coefficients represent the magnitude and sense (positive or negative) of the electromagnetic coupling between resonators in the signal path.

A coupling coefficient matrix m, for a six-resonator, canonical, bandpass filter is shown below, with the signal entering at resonance 1 and exiting at resonance 6, and where $m_{x,y}=m_{y,x}$ (m is symmetric about its principle diagonal), and $m_{x,y}$ represents the coupling between resonances x and y. Typically, only the value of $m_{2,5}$ is negative, so that two real frequency zeros of transmission are contributed to the filter response. Also, the magnitude of $m_{2,5}$, $|m_{2,5}|$, is typically about an order of magnitude smaller than the magnitudes of the other non-zero couplings. The structure is termed "canonic" because it involves the minimum number of couplings needed to achieve its level of filter performance (that is, six poles and two zeros of transmission).

$$m=\begin{matrix} 0 & m_{1,2} & 0 & 0 & 0 & 0 \\ m_{2,1} & 0 & m_{2,3} & 0 & m_{2,5} & 0 \\ 0 & m_{3,2} & 0 & m_{3,4} & 0 & 0 \\ 0 & 0 & m_{4,3} & 0 & m_{4,5} & 0 \\ 0 & m_{5,2} & 0 & m_{5,4} & 0 & m_{5,6} \\ 0 & 0 & 0 & 0 & m_{6,5} & 0 \end{matrix}$$

This matrix can then be transformed to achieve a new realization while retaining the power transfer characteristic it represents by applying successive similarity transformations of the form:

$$B=R_{p,q}^{T}\cdot A\cdot R_{p,q}$$

or $$B=R_{p,q}\cdot A\cdot R_{p,q}^{T}$$

Here, $R_{p,q}$ is known as a plane rotation matrix, which is an identity matrix with matrix elements $R_{p,p}=R_{q,q}=\cos\theta_{p,q}$ and $R_{p,q}=-R_{q,p}=\sin\theta_{p,q}$ for $p\neq q$, where p and q are matrix indices and $\theta_{p,q}$ is defined as the rotation angle of the plane rotation matrix $R_{p,q}$. A new coupling coefficient matrix M is formed by post-multiplying m by $R_{p,q}$ and pre-multiplying the result by $R_{p,q}^{T}$ (which is the transpose of $R_{p,q}$), or by post-multiplying m by $R_{p,q}^{T}$ and pre-multiplying the result by $R_{p,q}$ (which is the transpose of $R_{p,q}^{T}$).

For example, m can be transformed from its canonical form into an "in-line" or "longitudinal" form using a plane rotation matrix $R_{2,4}$ of the form:

$$R_{2,4}=\begin{matrix} 1 & 0 & 0 & 0 & 0 & 0 \\ 0 & \cos\theta_{2,4} & 0 & \sin\theta_{2,4} & 0 & 0 \\ 0 & 0 & 1 & 0 & 0 & 0 \\ 0 & -\sin\theta_{2,4} & 0 & \cos\theta_{2,4} & 0 & 0 \\ 0 & 0 & 0 & 0 & 1 & 0 \\ 0 & 0 & 0 & 0 & 0 & 1 \end{matrix}$$

where rotation angle $\theta_{2,4}=\tan^{-1}(m_{2,5}/m_{4,5})$. The new coupling coefficient matrix is $$M=R_{2,4}^{T}\cdot m\cdot R_{2,4},$$

where $$M=\begin{matrix} 0 & M_{1,2} & 0 & M_{1,4} & 0 & 0 \\ M_{2,1} & 0 & M_{2,3} & 0 & 0 & 0 \\ 0 & M_{3,2} & 0 & M_{3,4} & 0 & M_{3,6} \\ M_{4,1} & 0 & M_{4,3} & 0 & M_{4,5} & 0 \\ 0 & 0 & 0 & M_{5,4} & 0 & M_{5,6} \\ 0 & 0 & M_{6,3} & 0 & M_{6,5} & 0 \end{matrix}$$

Note that the similarity transformation, which uses this rotation matrix and this choice of rotation angle, has resulted in the elimination of the $M_{2,5}$ coupling and the creation of new $M_{1,4}$ and $M_{3,6}$ couplings. Here again, the couplings adjacent to the principal diagonal are all positive, while $M_{1,4}$ and $M_{3,6}$ are both negative and approximately an order of magnitude, or more, smaller than the other non-zero couplings. The matrix is still symmetrical about the principal diagonal.

Although it is generally acknowledged that an infinite number of different realizations of a particular transfer characteristic are possible, currently known filter synthesis and transformation techniques direct a designer to discover only a limited few of these, such as the single canonical and single longitudinal realizations mentioned above. Consequently, it has not been evident, even to experts in the field, that some more advantageous filter realizations are possible.

For example, in a certain type of six-resonance communication filter, the desirability of a particular filter realization not available from traditional design techniques is apparent. This situation will be described next.

In the microwave frequency realm, it is common to use a conductive cavity as a resonant element, with the cavity's shape and dimensions, and the locations, shapes, dielectric constants, and dimensions of dielectrics within the cavity being responsible for the cavities' resonant modes and their resonant frequencies. Enforcing various degrees of electromagnetic coupling between these resonances determines a specific signal power transfer characteristic as a function of signal frequency, so that the resonances together with the couplings form a frequency filter for the signal. Such filters with multiple signal paths are commonly known as multiple-coupled resonator waveguide filters, and have been used extensively in satellite communication systems. Initially, the cavity resonators had air dielectric interiors. More recently, improvements in the properties of certain ceramic materials have allowed the practice of partially loading the cavities with a low-loss, high dielectric constant ceramic, leading to further reductions in the size and weight of the filters.

This multiple-coupled cavity, multiple-mode dielectric resonator filter technology has been demonstrated to have significant performance and size advantages over simple cascade connected, single-mode non-dielectrically loaded waveguide cavity filter technology. However, as the number of resonant modes per cavity increases, the tuning complexity increases significantly. This efficiency/complexity trade-off has lead to dual-mode filters being more attractive than triple or higher-order mode filters in cost-sensitive, large product quantity applications. One particularly popular dielectrically loaded cavity dual-mode is the orthogonal $HEH_{11}$ ($EH_{11}\delta$) mode. Another is the $TM_{110}$ mode.

In $HEH_{11}$ dual-mode dielectric resonator filters, each physical resonator is comprised of a circularly cylindrical waveguide cavity containing a circularly cylindrical high dielectric constant (typically, $\epsilon_r \geqq 34$), low-loss ceramic, which only partially fills the cavity, and is typically supported within the cavity with a minimum amount of low dielectric constant (typically, $1<\epsilon_r<10$), low loss dielectric material so that the axis of the cavity coincides with the axis of the ceramic. The dimensions of the cavity and the ceramic are chosen to realize two orthogonal resonances at a common frequency, typically corresponding to the center frequency of the passband of the filter.

It is conventional to introduce asymmetries into the cavity, or the ceramic, to produce the desired amount of coupling between the orthogonal modes. These asymmetries can be adjustable conductive or insulating tuning screws or members, or they can be permanent deformations such as cuts, notches, or protrusions. This coupling between the orthogonal modes of a single resonator will be termed intra-resonator coupling.

Resonant modes on physically adjacent, but separate, dual-mode resonators can be coupled together by placing the ceramics in a common cavity and adjusting the shape and dimensions and contents of the section of the cavity between the ceramics. Smaller couplings are conventionally achieved by spacing the ceramics farther apart within the cavity, or by reducing the non-conductive cross-sectional area of a portion of the inside of the cavity between adjacent ceramics, such as through the use of irises of a variety of thicknesses and shapes. These couplings can also be made adjustable through the use of any type of conductive or insulating member whose orientation, extent, or location within the section of cavity between the ceramics can be adjusted. This coupling between a resonant mode of one resonator and a resonant mode of another, physically separate, resonator will be termed inter-resonator coupling. Furthermore, although it is conventional for inter-resonator couplings to occur between parallel modes, the intervening cavity and its contents can be shaped to provide coupling between orthogonal modes as well.

Also, one must have a means for introducing and extracting a signal from the filter. For these filters, one can choose to have the signal input and output ports coupled to orthogonal modes on the same resonator, or to a mode or modes on physically separate resonators. An example of the former would be a realization of the canonical filter coupling matrix shown above, where resonances 1 and 6 would be orthogonal modes of a first dual-mode resonator, resonances 2 and 5 would be orthogonal modes of a second dual-mode resonator, and resonances 3 and 4 would be orthogonal modes of a third dual-mode resonator. An example of the latter would be a realization of the longitudinal filter coupling matrix shown above, where resonances 1 and 2 would be orthogonal modes of a first dual-mode resonator, resonances 4 and 3 would be orthogonal modes of a second dual-mode resonator, and resonances 5 and 6 would be orthogonal modes of a third dual-mode resonator.

When designed by conventional methods, the canonical dual-mode filter realization has the desirable characteristic of having relatively large inter-resonator couplings, which are also sometimes equal ($m_{1,2}$, $m_{2,3}$, $m_{4,5}$, and $m_{5,6}$ are much greater than $m_{2,5}$, and, sometimes, $m_{1,2}=m_{5,6}$ and $m_{2,3}=m_{4,5}$), while having mostly small intra-resonator couplings ($m_{1,6}$ and $m_{2,5}$ are both much smaller than the inter-resonator couplings). Unfortunately, the input and output are difficult to isolate since they exist orthogonally on the same physical resonator. The maximum input-to-output isolation attainable in dual-mode filters is reported to be only about 25 to 30 dB, resulting in a significant degradation of filter stopband performance, in some applications.

The longitudinal dual-mode filter realization has significantly better input-to-output isolation, since the input and output exist in physically separate resonators, having no direct coupling between their resonant modes. However, when designed by conventional methods, the inter-resonator couplings are substantially different ($m_{2,3} \gg m_{1,4}$ and $m_{4,5} \gg m_{3,6}$) and the intra-resonator couplings $m_{1,2}$,$m_{3,4}$, and $m_{5,6}$ are all rather large. In order to maintain reasonable filter sizes, bulkheads or plates with coupling slots known as irises are typically employed between adjacent dual-mode resonators to realize the two very different coupling magnitudes in a single space between each pair of adjacent resonators. But these coupling irises add insertion loss, decreasing filter performance, and significantly complicate the design and construction of the filters, increasing manufacturing costs. Realizing the large intra-resonator couplings can lead to increased manufacturing costs if more complicated cavity or ceramic shapes are used, and they can lead to decreased environmental stability and increased insertion loss as tuning elements, or portions of the cavity and ceramics, are brought in closer proximity to each other.

Recently, longitudinal dual-mode dielectric resonator filters without irises (designed by traditional means) have been proposed. Unfortunately, since the alternative proposed inter-resonator coupling means (metal tuning screws) only act to increase coupling between adjacent ceramics, the smallest inter-resonator couplings (i.e., $m_{1,4}$ and $m_{3,6}$) determine the size of the physical separation between the adjacent ceramics, and the resulting filters are intolerably large for many applications. In addition, inter-resonator coupling screws used to realize the larger couplings ($m_{2,3}$ and $m_{4,5}$) can easily become so large, and penetrate into the cavity so deeply, that they can create unintended couplings and resonances within the filter which can significantly distort and degrade the filter performance.

Also, in both the canonical and longitudinal designs discussed above, two of the six resonant modes are involved in as many as three couplings to other resonant modes. The tuning of these triple-coupled resonances and their couplings is significantly more difficult than the tuning of the other single- and/or double-coupled resonances and their couplings. This added complexity translates into increased manufacturing costs.

Consequently, for dual-mode bandpass filters, it is desirable for inter-resonator couplings to be as large as possible, to minimize the physical separations between adjacent resonators, or to maximize the sizes of coupling irises (or minimize the sizes and penetrations of coupling screws) in order to minimize their insertion loss degradation and allow their mechanical tolerances to be relaxed, thereby reducing their manufacturing costs. Further, it is desirable for intra-resonator couplings to be as small as possible in order to minimize insertion loss and environmental instability due to the coupling mechanisms. Also, it is desirable for inter-resonator couplings that share the same inter-resonator separation to be as nearly equal in magnitude as possible in order to facilitate simplified iris shapes (such as circular or rectangular, rather than cross- or slot-shaped) or reduced size and penetration of coupling screws, with their commensurate reductions in manufacturing costs and improvements in filter performance. In addition, it is preferable to maximize the isolation between the input and output, minimizing degradation of filter performance. And, it is desirable to minimize the maximum number of couplings to any given resonant mode in order to simplify the tuning procedure during manufacturing, and thereby reduce manufacturing costs. It is recognized that conventional filter design methodologies do not lead to designs containing a significant majority of these desirable qualities, and that, consequently, conventional dual-mode bandpass filter implementations do not embody a significant majority of these desirable qualities.

SUMMARY OF THE INVENTION

These needs and others are satisfied by the method of the present invention, in which a multiple signal path, frequency spectrum filter is constructed. The filter includes elements giving rise to at least five resonances at a common frequency, $f_0$, means for coupling signal energy between at least some of the resonances, signal input means for coupling an input signal to at least one of the resonances, signal output means for coupling an output signal from at least one of said resonances, sequential connections of one or more of the means for coupling signal energy forming signal paths, at least two signal paths connecting the input means with the output means, and the two signal paths differing in at least one coupling. The method comprises forming a matrix of resonator coupling coefficients, m, representing and satisfying a pre-determined power transfer characteristic, and selecting an ordered set of plane rotation matrices $\{R_{p1,q1}, R_{p2,q2}, \ldots, R_{pn,qn}\}$. Each plane rotation matrix, $R_{pi,qi}$, is a modified identity matrix having a rotation angle, $\theta_{pi,qi}$, matrix elements $R_{pi,pi}=R_{qi,qi}=\cos[\theta_{pi,qi}]$, and matrix elements $R_{pi,qi}=(-R_{qi,pi})=\sin[\theta_{pi,qi}]$, where the subscripts pi and qi of the rotation matrix elements represent the matrix row and column indices, respectively, and where at least one rotation angle of one plane rotation matrix is selected as an independent variable. The method also includes performing a sequence of ordered orthogonal similarity transformation updates on the coupling coefficient matrix:

$$M_i=R_{pi,qi}^T\cdot M_{i-1}\cdot R_{pi,qi} \text{ (or } M_i=R_{pi,qi}\cdot M_{i-1}\cdot R_{pi,qi}^T),$$

where $M_0=m$ and $i=1,2,\ldots,n$, constructing a plot of functions of at least some of the elements of the orthogonally transformed coupling coefficient matrix, $M_n$, as a function of the independent rotation angle variables to create a design space plot, selecting, in accordance with at least one predetermined criterion, a preferred filter realization, corresponding to a particular value of each of the independent variables, from the design space plot, and constructing a filter in accordance with the preferred filter realization.

In one embodiment, the filter comprises first, second, and third dual-mode microwave resonators spaced along a common first axis, in a shared conductive enclosure, each exhibiting a first and a second mutually perpendicular resonance mode wherein both of the modes are oriented perpendicularly to the first axis, and wherein the first modes of each resonator are oriented along a common first plane and the second modes of each resonator are oriented along a common second plane orthogonal to the first plane, such that all first modes are mutually parallel and all second modes are mutually parallel;

The filter further includes tuning means for adjusting the resonant frequencies of each of the resonance modes, mode coupling means for causing a first mutual coupling of energy between the orthogonal first and second resonances of the first resonator, mode coupling means for causing a second mutual coupling of energy between the orthogonal first and second resonances of the second resonator, mode coupling means for causing a third mutual coupling of energy between the orthogonal first and second resonances of the third resonator, mode coupling means for causing a fourth mutual coupling of energy between the parallel first resonances of the first and second resonators, and mode coupling means for causing a fifth mutual coupling of energy between the parallel second resonances of the first and second resonators. The filter also includes mode coupling means for causing a sixth mutual coupling of energy between the parallel first resonances of the second and third resonators, mode coupling means for causing a seventh mutual coupling of energy between the parallel second resonances of the second and third resonators, input means for coupling microwave energy into at least one of the resonances of the first resonator, and output means for coupling a portion of the microwave energy out of at least one of the resonances of the third resonator. The magnitudes of each of the mutual couplings of orthogonal resonances are less than the magnitudes of each of the mutual couplings of parallel resonances.

BRIEF DESCRIPTION OF THE DRAWINGS

FIG. 1(*b*) illustrates resonant mode electric field axes and cascade coupling notations corresponding to the filter realization of FIG. 1(*a*), with stylized definitions of electric field orientations and corresponding normalized coupling coefficients $M_{x,y}$;

FIG. 6(*b*) is an exterior side view of the filter of FIG. 6(*a*);

FIG. 6(*c*) is a series of cross-sectional schematic end views of the filter elements of FIG. 6(*a*);

DETAILED DESCRIPTION OF THE INVENTION

Figure 1A:
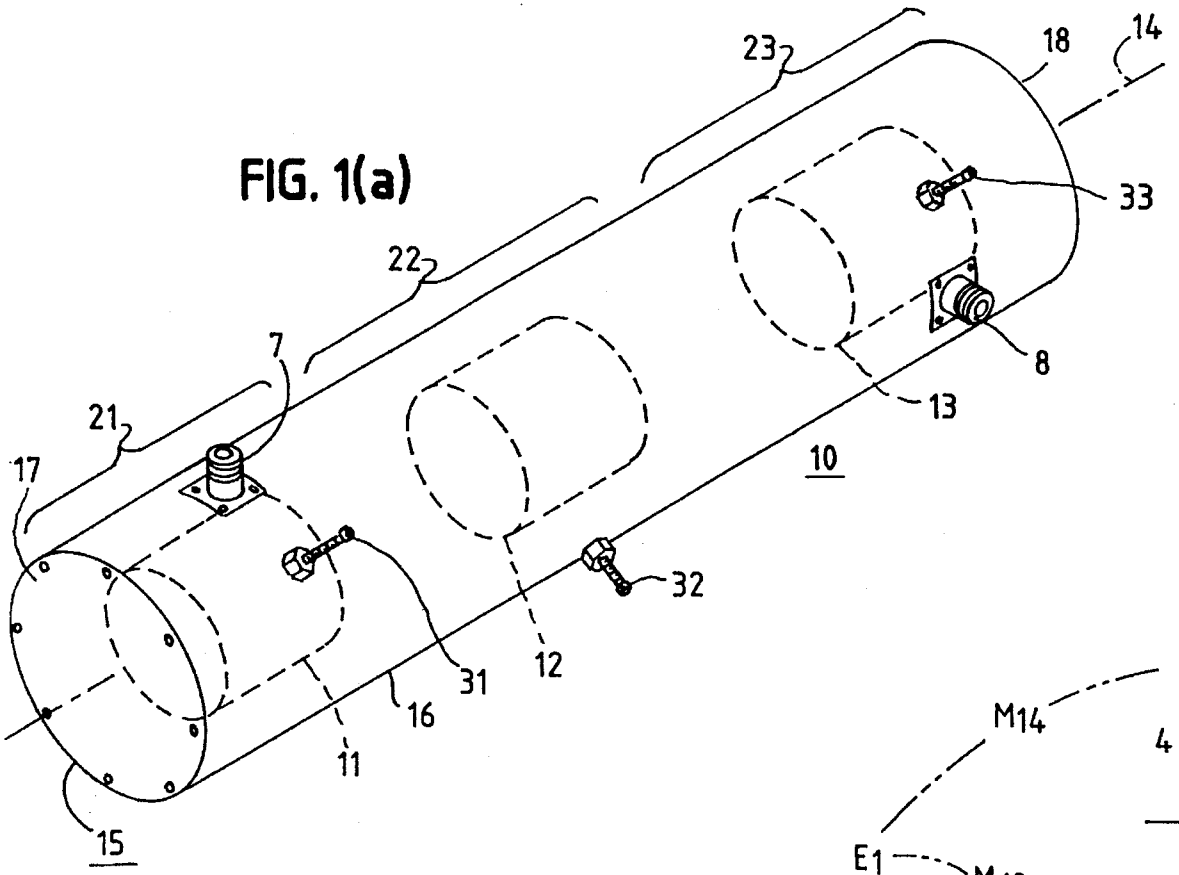
FIG. 1(*a*) is a simplified perspective view of a three resonator, six resonance, longitudinal realization of a dual-mode dielectric resonator bandpass filter without irises, illustrating the structure of the longitudinal form.

In accordance with the present invention, a multiple signal path, multiple mode filter and method are described that provide distinct advantages when compared to those of the prior art. The invention can best be understood with reference to the accompanying drawing figures.

For illustration purposes, the embodiments of six-resonance bandpass filters will be described, although it should be understood that this invention is not limited to the incorporation of six resonances.

According to the present invention, as a starting point, it is assumed that a normalized coupling coefficient matrix for a canonical filter design satisfying a pre-determined transfer characteristic requirement has been deduced according to conventional means. For illustration purposes, the transfer characteristic requirements correspond to those for a certain base station preselect filter for a cellular telephone application, and in particular correspond to a bandpass filter which is to pass signals in the 845 MHz to 846.5 MHz frequency range with as little attenuation as possible, which is to attenuate signals below 844.2 MHz and above 847.3 MHz as much as possible, and which is to be placed in the signal path between an antenna and an amplifier in a receiver application.

The operating frequency and the combined size, cost, and performance constraints of this particular application suggested limiting the number of resonances to six and choosing to implement the filter using dual-mode dielectric resonator technology. Such a filter 10 is sketched in FIG. 1(*a*) and (*b*). The filter 10 consists of first, second, and third circular cylindrical, high dielectric constant, ceramic elements, 11, 12, and 13, respectively, which are disposed within, and share a common axis 14 with, the circular cylindrical conductive cavity 15. A suitable ceramic material for 11, 12, and 13 is a low loss (low dielectric loss tangent) Barium Titanate ($BaO/TiO_2$) ceramic with a dielectric constant of approximately 34 and a temperature coefficient of frequency, $\tau_f$, of approximately zero, although other ceramics with other properties could be used as well.

Typically, the cavity material is copper, or a copper- or silver-plated, low thermal expansion coefficient material, such as aluminum, steel, or Invar. A copper- or silver-plated dielectric material, such as graphite or plastic, could also be used. The cavity can be constructed in any of a number of ways. Here, it is formed from a single central tube 16 with end plates 17 and 18 screwed onto and covering each end.

Figure 1B:
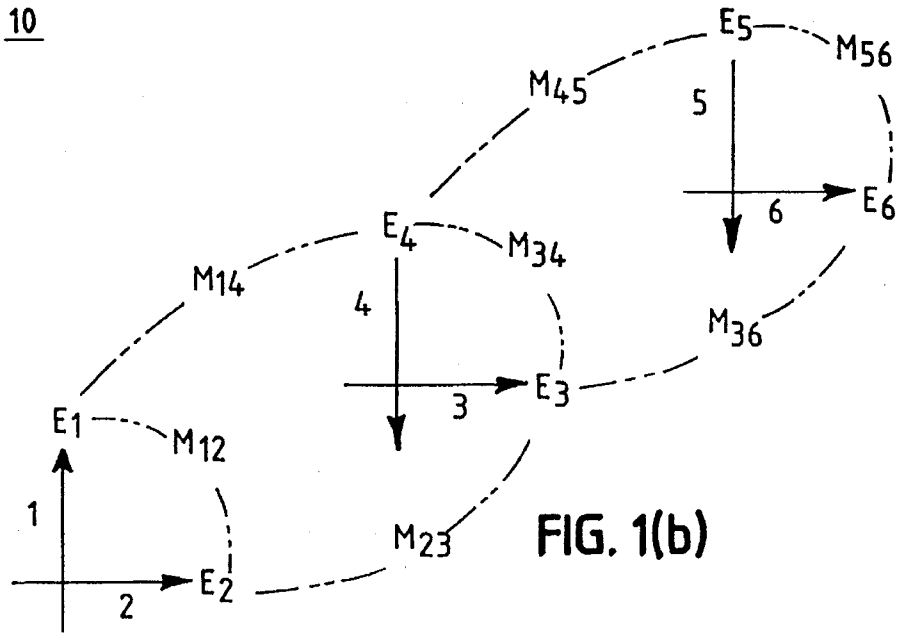

The ceramic elements 11, 12, 13 are supported within the cavity 15, and are preferably separated from its conductive surface, by additional low loss dielectric material (not shown). The ceramic elements, together with the cavity and the supports, form what are conventionally known as $HEH_{11}$ dual-mode dielectric resonators. One of such resonators 21, 22, 23 is associated with each of the ceramic elements 11, 12, 13, respectively. As noted on page 23 in "Investigation of Microwave Dielectric Resonator Filters," Rantec Report #7, March–May 1965, NTIS Document #474147, by S. B. Cohn and E. N. Torgow, the dual-mode resonances of a cavity loaded with a high dielectric constant material are "analogous" to the dual-mode resonances of a cavity loaded with a low dielectric constant material such as air. Consequently, the electromagnetic characteristics, frequency tuning methods, and mode coupling methods of each resonator can be understood by referring to pages 673–677 of section 10.10, "The Design of Microwave Filters: Cavities Excited in More Than One Mode," by A. W. Lawson and R. M. Fano in *Microwave Transmission Circuits,* (McGraw-Hill Book Company, New York, 1948), edited by George L. Ragan. Hence, as shown in FIG. 1(*b*), each dual-mode dielectric resonator can be characterized as having two resonances at similar frequencies, which are mutually orthogonal to each other and to the filter's common axis 14, and whose resonant frequencies are determined to various extents by the size and shape of the cavity and the size, shape, location, and various material properties of all of the materials within the cavity (including supports, coupling tuning mechanisms, and signal input and output mechanisms).

As it is both difficult and expensive to control any of these parameters precisely enough to guarantee unadjusted resonant frequencies accurate enough for this narrow-band application, conductive metal screws are used to adjust, or tune, the frequency of each independent mode. These frequency tuning screws (not shown) are placed through the cavity wall, generally toward the center of the ceramic element, and predominantly along the main axis of each mode's electric field. As the penetration of a frequency tuning screw into the cavity is increased, the frequency of the associated $HEH_{11}$ mode is lowered. As the screw is retracted from the cavity, the associated mode's frequency is raised. The frequency tuning screws can be placed in a variety of locations and orientations, but they will have a greater effect on a mode's frequency if they are placed where that mode's electric field is stronger. Also, it is generally desirable to have each mode's frequency as independent as possible from the frequency adjustment mechanisms of other modes, so, consequently, it is desirable to place a mode's frequency tuning screw in a location where the electric fields of other modes are weak.

If all of the shapes, positions, and compositions of the materials of filter 10 were ideal, there would be negligible coupling (i.e., intra-resonator coupling) between the orthogonal modes on each resonator. Intra-resonator coupling can be introduced by creating an asymmetry between two adjacent quadrants of a dual-mode resonator. Further, this coupling can be defined to have a certain polarity, depending on which quadrant has the dominant asymmetry. As discussed in Ragan, one way to create such an asymmetry is to place a conductive metal intra-resonator coupling screw in the same plane as the two mode frequency tuning screws, which are at 90 degrees to each other, but oriented 45 degrees off from the axes of those screws. Screws 31, 32, 33 act as intra-resonator mode coupling screws. The deeper the penetration of such a coupling screw into the cavity, the greater the intra-resonator mode coupling. However, another screw in the same plane, but oriented orthogonally to the first intra-resonator coupling screw, can act to restore symmetry (either in reality or effectively) to the resonator structure and thereby cancel some or all of the intra-resonator coupling created by the first screw. This second screw can also cause the polarity of the coupling to change as it is adjusted to become the more dominant of the screws.

In practice, the shapes, positions, and compositions of the materials of filter 10 are not ideal. Consequently, there is often some amount of intra-resonator mode coupling of some polarity inherent in the structure without the use of dedicated intra-resonator mode coupling mechanisms. Therefore, it can be useful to have two orthogonal intra-resonator mode coupling screws associated with each dual-mode resonator to permit the adjustment of the mode coupling in either an increasing or decreasing manner and in either polarity.

The general six-by-six coupling coefficient matrix is:

$$m=\begin{matrix} 0 & m_{1,2} & m_{1,3} & m_{1,4} & m_{1,5} & m_{1,6} \\ m_{2,1} & 0 & m_{,23} & m_{2,4} & m_{2,5} & m_{2,6} \\ m_{3,1} & m_{3,2} & 0 & m_{3,4} & m_{3,5} & m_{3,6} \\ m_{4,1} & m_{4,2} & m_{4,3} & 0 & m_{4,5} & m_{4,6} \\ m_{5,1} & m_{5,2} & m_{5,3} & m_{5,4} & 0 & m_{5,6} \\ m_{6,1} & m_{6,2} & m_{6,3} & m_{6,4} & m_{6,5} & 0 \end{matrix}$$

and the corresponding normalized coupling coefficient matrix for the predetermined canonical bandpass filter design is:

$$m=\begin{matrix} 0 & 1.08181 & 0 & 0 & 0 & 0 \\ 1.08181 & 0 & 0.794538 & 0 & -0.180098 & 0 \\ 0 & 0.794538 & 0 & 0.926300 & 0 & 0 \\ 0 & 0 & 0.926300 & 0 & 0.750057 & 0 \\ 0 & -0.180098 & 0 & 0.750057 & 0 & 0.988848 \\ 0 & 0 & 0 & 0 & 0.988848 & 0 \end{matrix}$$

where the normalized input and output impedances are $R_{ni}$=1.192839 and $R_{no}$=0.990822, respectively, the center frequency is 845.75 MHz, and the fractional bandwidth is 1.54/845.75.

Figure 2:
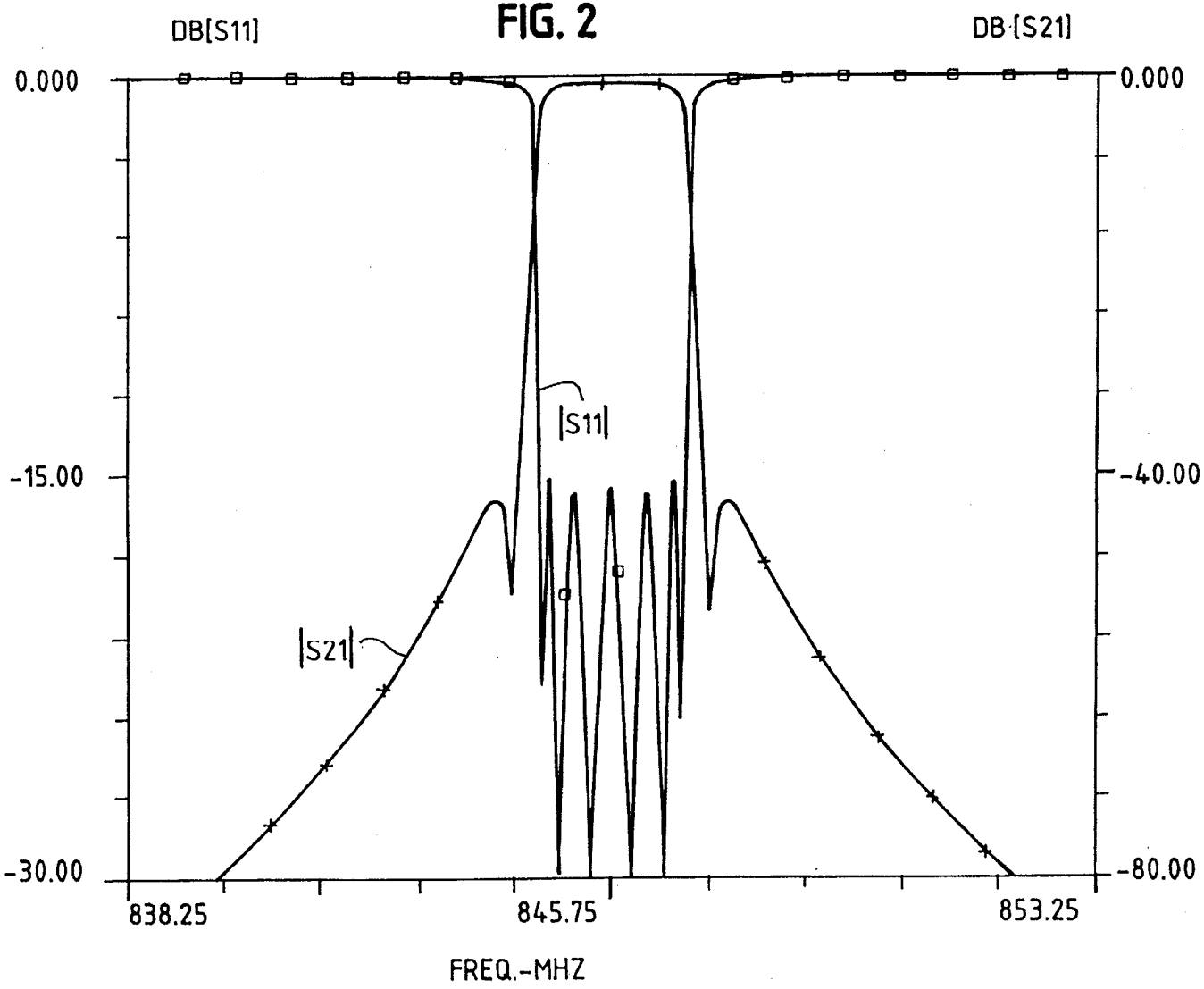
FIG. 2 is a graph showing the computed insertion loss (|S21|) and return loss (|S11|) over the frequency range of 838.25 MHz to 953.25 MHz for the designs of FIG. 4, the circuit schematic of FIG. 5, and the embodiment of FIGS. 6(*a*)–6(*c*)
Figure 3:
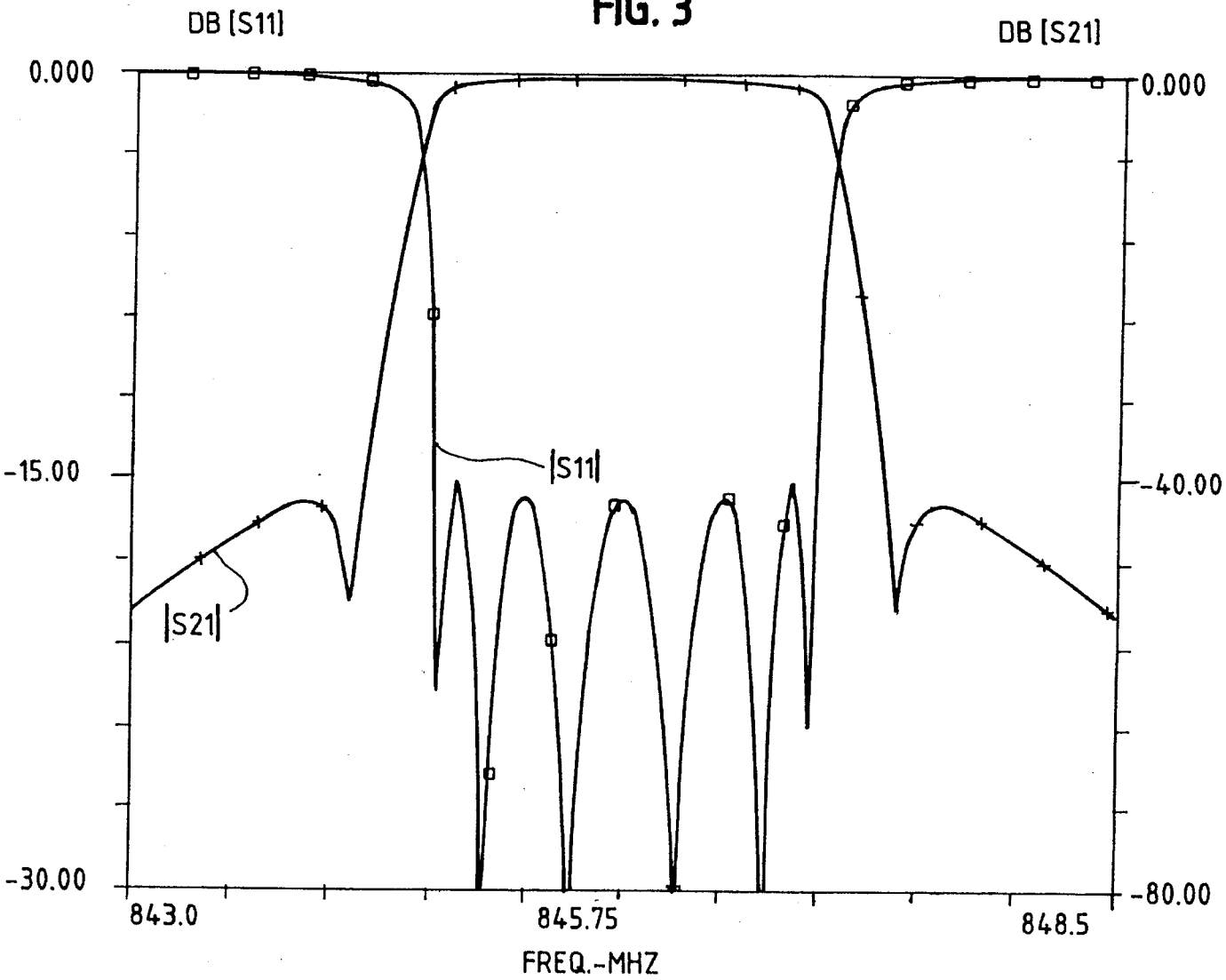
FIG. 3 is a graph depicting the computed insertion loss (|S21|) and return loss (|S11|) over the frequency range of 843 MHz to 848.5 MHz for the designs of FIG. 4, the circuit schematic of FIG. 5, and the embodiment of FIGS. 6(*a*)–6(*c*)
Figure 4:
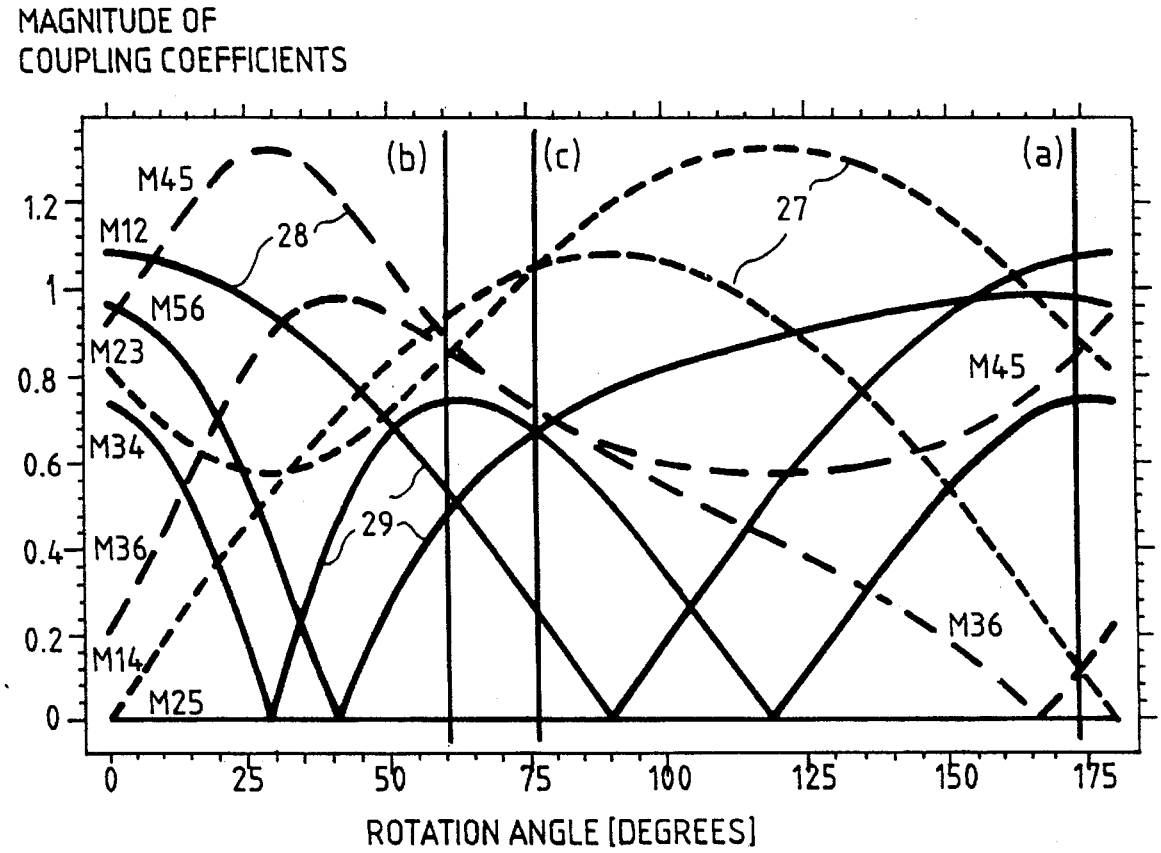
FIG. 4 is a design space plot of normalized resonance coupling coefficient magnitudes for six-resonance longitudinal dual-mode filter realizations versus rotation angle $\theta_{2,4}$ of a plane rotation matrix $R_{2,4}$.

The calculated performance of this design is shown in FIGS. 2 and 3. Although this theoretical performance is acceptable for the given application, for the reasons already stated, such a canonical form of implementation is not desirable. Again, to achieve closer to theoretical stopband attenuation, a longitudinal implementation is preferred. However, as previously discussed, practical implementations of traditional longitudinal forms, with a performance characteristic equivalent to the canonical design, have several significant undesirable characteristics of their own. Consequently, it is desirable to find an alternative longitudinal implementation with fewer undesirable features, even though, in general, one does not know a priori whether such an alternative exists. Therefore, in accordance with the present invention, plots of a continuous range of normalized coupling coefficient values, representing a continuous range of alternative, but characteristically equivalent, longitudinal filter implementations are made. Such a design space plot is illustrated in FIG. 4. This plot has been constructed by taking the magnitudes of the normalized coupling coefficients of the matrix M, resulting from applying an orthogonal similarity transformation to the initial normalized coupling coefficient matrix m of the canonical design above. The specific mapping used in this case is as follows:

$$M=R_{2,4}^{T}\cdot R_{3,5}^{T}\cdot m\cdot R_{3,5}\cdot R_{2,4}$$

where $R_{2,4}$ is a plane rotation matrix of the form:

$$R_{2,4}=\begin{matrix} 1 & 0 & 0 & 0 & 0 & 0 \\ 0 & \cos\theta_{2,4} & 0 & \sin\theta_{2,4} & 0 & 0 \\ 0 & 0 & 1 & 0 & 0 & 0 \\ 0 & -\sin\theta_{2,4} & 0 & \cos\theta_{2,4} & 0 & 0 \\ 0 & 0 & 0 & 0 & 1 & 0 \\ 0 & 0 & 0 & 0 & 0 & 1 \end{matrix}$$

and where $R_{3,5}$ is a plane rotation matrix of the form:

$$R_{3,5}=\begin{matrix} 1 & 0 & 0 & 0 & 0 & 0 \\ 0 & 1 & 0 & 0 & 0 & 0 \\ 0 & 0 & \cos\theta_{3,5} & 0 & \sin\theta_{3,5} & 0 \\ 0 & 0 & 0 & 1 & 0 & 0 \\ 0 & 0 & -\sin\theta_{3,5} & 0 & \cos\theta_{3,5} & 0 \\ 0 & 0 & 0 & 0 & 0 & 1 \end{matrix}$$

and where $R_{2,4}^{T}$ and $R_{3,5}^{T}$ are the transposes of $R_{2,4}$ and $R_{3,5}$, respectively. The center frequency, fractional bandwidth, input and output impedances, and theoretical filter performance (i.e., transfer function) are all preserved under this type of transformation.

Unlike the traditional canonical-to-longitudinal mappings discussed earlier, which do not yield any independent variables over whose domain it is possible to plot a design space, this mapping does yield an independent variable. Either rotation angle is available as the independent variable for the purposes of constructing a design space plot. The result of this mapping is:

$$M=\begin{matrix} 0 & M_{1,2} & 0 & M_{1,4} & 0 & M_{1,6} \\ M_{2,1} & 0 & M_{2,3} & 0 & M_{2,5} & 0 \\ 0 & M_{3,2} & 0 & M_{3,4} & 0 & M_{3,6} \\ M_{4,1} & 0 & M_{4,3} & 0 & M_{4,5} & 0 \\ 0 & M_{5,2} & 0 & M_{5,4} & 0 & M_{5,6} \\ M_{6,1} & 0 & M_{6,3} & 0 & M_{6,5} & 0 \end{matrix}$$

where the elements of the orthogonally transformed resonator coupling coefficient matrix are:

$$M_{1,2}=m_{1,2}c_{2,4}-m_{1,4}s_{2,4}$$

$$M_{2,3}=m_{2,3}c_{2,4}c_{3,5}-m_{3,4}s_{2,4}c_{3,5}+m_{4,5}s_{2,4}s_{3,5}-m_{2,5}c_{2,4}s_{3,5},$$

$$M_{3,4}=m_{2,3}s_{2,4}c_{3,5}+m_{3,4}c_{2,4}c_{3,5}-m_{4,5}c_{2,4}s_{3,5}-m_{2,5}s_{2,4}s_{3,5},$$

$$M_{4,5}=m_{2,3}s_{2,4}s_{3,5}+m_{3,4}c_{2,4}s_{3,5}+m_{4,5}c_{2,4}c_{3,5}+m_{2,4}s_{2,4}c_{3,5}$$

$$M_{5,6}=m_{3,6}s_{3,5}+m_{5,6}c_{3,5},$$

$$M_{1,4}=m_{1,4}c_{2,4}+m_{1,2}s_{2,4},$$

$$M_{2,5}=m_{2,3}c_{2,4}s_{3,5}-m_{3,4}s_{2,4}s_{3,5}-m_{4,5}s_{2,4}c_{3,5}+m_{2,5}c_{2,4}c_{3,5},$$

$$M_{3,6}=m_{3,6}c_{3,5}-m_{5,6}s_{3,5},$$

$$M_{1,6}=m_{1,6},$$

$$s_{x,y}=\sin[\theta_{x,y}],$$

$$c_{x,y}=\cos[\theta_{x,y}],$$

and $m_{x,y}=m_{y,x}$ and $M_{x,y}=M_{y,x}$.

In this case, rotation angle $\theta_{2,4}$ has been chosen as the independent variable. Consequently, to solve for all of the electrically equivalent longitudinal designs for a dual-mode resonator implementation (i.e., for $M_{2,5}=M_{5,2}=0$), then $\theta_{3,5}$ must be $$\theta_{3,5}=\arctan[-(m_{2,5}-m_{4,5}\tan[\theta_{2,4}])/(m_{2,3}-m_{3,4}\tan[\theta_{2,4}])],$$

which, for this example, becomes $$\theta_{3,5}=\arctan[0.750057\tan[\theta_{2,4}]/(0.794538-0.926300\tan[\theta_{2,4}])],.$$

Again, the design space plot of this example is shown in FIG. 4, where the short-dashed lines 27 indicate the inter-resonator coupling magnitudes between resonators 21 and 22, the long-dashed lines 28 indicate the inter-resonator coupling magnitudes between resonators 22 and 23, and solid lines 29 indicate intra-resonator couplings. This plot has been constructed by taking the magnitudes of the normalized coupling coefficients of the matrix M, resulting from applying the given orthogonal similarity transformation to the initial normalized coupling coefficient matrix m of the canonical design, above. Vertical lines superimposed on the plot correspond to various values of the rotation angle $\theta_{2,4}$ and intersect (a) conventional, (b) improved, and (c) preferred designs.

The starting matrix m could be other than a canonical design (for instance, it could be a longitudinal design as well), different spans of the domain and range of the plot could be chosen, other parameters could be derived to plot from the results of the transformation, and other transformations could be used for higher order filters, or for examining filter implementation forms other than this longitudinal form, without deviating from the scope of the invention. The key concept is that an orthogonal similarity transformation is applied to an initial design, resulting in equations, in one or more independent variables, for elements of alternate designs. Further, constructing a plot is only one of several ways of presenting the results of the transformation for inspection.

Design (a) in FIG. 4, corresponding to $\theta_{2,4}=173.75562°$, is represented by the following normalized (signed magnitude) coupling coefficient matrix:

$$M=\begin{matrix} 0 & 1.07539 & 0 & -0.117668 & 0 & 0 \\ 1.07539 & 0 & 0.895892 & 0 & 0 & 0 \\ 0 & 0.895892 & 0 & 0.746202 & 0 & -0.107556 \\ -0.117688 & 0 & 0.746202 & 0 & 0.851412 & 0 \\ 0 & 0 & 0 & 0.851412 & 0 & 0.982981 \\ 0 & 0 & -0.107556 & 0 & 0.982981 & 0 \end{matrix}$$

This design (a) matrix represents a traditional longitudinal dual-mode bandpass filter realization. It has significantly better input-to-output isolation than the canonical form, since the input and output exist in physically separate resonators (the input to resonator 21 and the output to resonator 23) having no direct coupling between their resonant modes (1 and 6, respectively). However, the inter-resonator couplings are substantially different, with $|M_{2,3}|$ (=0.895892)>>$|M_{1,4}|$(=0.117688) and $|M_{4,5}|$(=0.851412)>>$|M_{3,6}|$ (=0.107556), and the intra-resonator couplings $M_{1,2}$, $M_{3,4}$, and $M_{5,6}$ are all relatively large (about 7 to 10 times larger than $m_{1,4}$ or $m_{3,6}$). As mentioned before, in order to maintain reasonable filter sizes, bulkheads or plates with irises are typically employed between adjacent dual-mode resonators to realize the two very different coupling magnitudes in the single space between each pair of adjacent resonators (i.e., the very different coupling magnitudes $|M_{2,3}|$ and $|M_{1,4}|$ between resonators 21 and 22 and $|M_{4,5}|$ and $|M_{3,6}|$ between resonators 22 and 23). But these coupling irises add insertion loss, decrease filter performance, and significantly complicate the design and construction of the filters, increasing manufacturing costs. Realizing the large intra-resonator couplings can lead to increased manufacturing costs if more complicated cavity or ceramic shapes are used, and they can lead to decreased environmental stability and increased insertion loss as tuning elements, or portions of the cavity and ceramics are brought in closer proximity to each other.

Examining the plot in FIG. 4 further, a superior alternative, design (c), is observed to correspond with $\theta_{2,4}=76.497887°$, which is represented by the following normalized coupling matrix:

$$M=\begin{matrix} 0 & 0.252582 & 0 & 1.05191 & 0 & 0 \\ 0.252582 & 0 & -1.05191 & 0 & 0 & 0 \\ 0 & -1.05191 & 0 & 0.672318 & 0 & 0.725132 \\ 1.05191 & 0 & 0.926300 & 0 & 0.725132 & 0 \\ 0 & 0 & 0 & -0.725132 & 0 & 0.672313 \\ 0 & 0 & 0.725132 & 0 & 0.672313 & 0 \end{matrix}$$

The design (c) matrix represents a new form of longitudinal dual-mode bandpass filter realization. The inter-resonator coupling magnitudes are equal, with $|M_{2,3}|=|M_{1,4}|=1.05191$ and $|M_{4,5}|=|M_{3,6}|=0.725132$, and coupling irises can be eliminated entirely or their sizes maximized and/or shapes simplified (from cross-shaped to circular or square-shaped, for example). However, in contrast to the canonical realization taught by Yoshio Kobayashi's "Double-Mode Filter," U.S. Pat. No. 4,760,361, Jul. 26, 1988 (which exhibits inter-resonator coupling magnitude properties similar to this invention, but calls for input and output means to share the same physical dual-mode resonator and thereby suffers from significant limitations in the achievable level of stop-band attenuation), this invention retains the superior input-to-output isolation of the traditional longitudinal dual-mode bandpass filter. But, in contrast to the traditional longitudinal realization of design (a), now the inter-resonator coupling magnitudes are all relatively large (from 8% to 416% larger than the intra-resonator coupling magnitudes), permitting minimal physical separations between adjacent resonators. Further, according to this example of the present invention, the magnitudes of the coupling coefficients determining the minimum physical spacing between adjacent dual-mode resonators are 7 to 10 times larger than those achieved by the realizations taught in Kawthar Zaki's "Dual-Mode Dielectric Resonator Filters Without Iris," U.S. Pat. No. 5,083,102, Jan. 21, 1992, which exhibit a similar longitudinal form without irises. Filters without irises are, therefore, significantly smaller when implemented in accordance with this invention, as compared to those implemented in accordance with Zaki's approach. And, since the inter-resonator coupling magnitudes are equal, with $|M_{2,3}|=|M_{1,4}|=1.05191$ and $|M_{4,5}|=|M_{3,6}|=0.725132$, (as in this example, or, as is more general, are at least similar in magnitude or are within 50% of each other) elements such as coupling screws are not needed to substantially alter the direct, free-space coupling between adjacent parallel resonant modes, as is-required by Zaki's approach. Although the need for coupling screws has been eliminated, coupling tuning screws are generally necessary, but only to the extent that the manufacturing technology used to realize the filters is unable to accurately and repeatably achieve the designed couplings, or to the extent that the filters' mechanical tolerances have been relaxed to reduce manufacturing costs. In general, for equivalent diameters, the extent of penetration of these inter-resonator coupling tuning screws will be significantly less than the inter-resonator coupling screws required by Zaki's approach. This offers a potential reduction in any insertion loss degradation, or spurious resonances, caused by these screws.

According to the present invention, the intra-resonator couplings of design (c) are relatively small in order to minimize insertion loss and environmental instability due to the coupling mechanisms (screws 31, 32, 33). In contrast, in this example, Kobayashi's and Zaki's approaches require intra-resonator couplings about 38% and 60% larger, respectively, than the largest intra-resonator coupling of the approach described herein.

Figure 5:
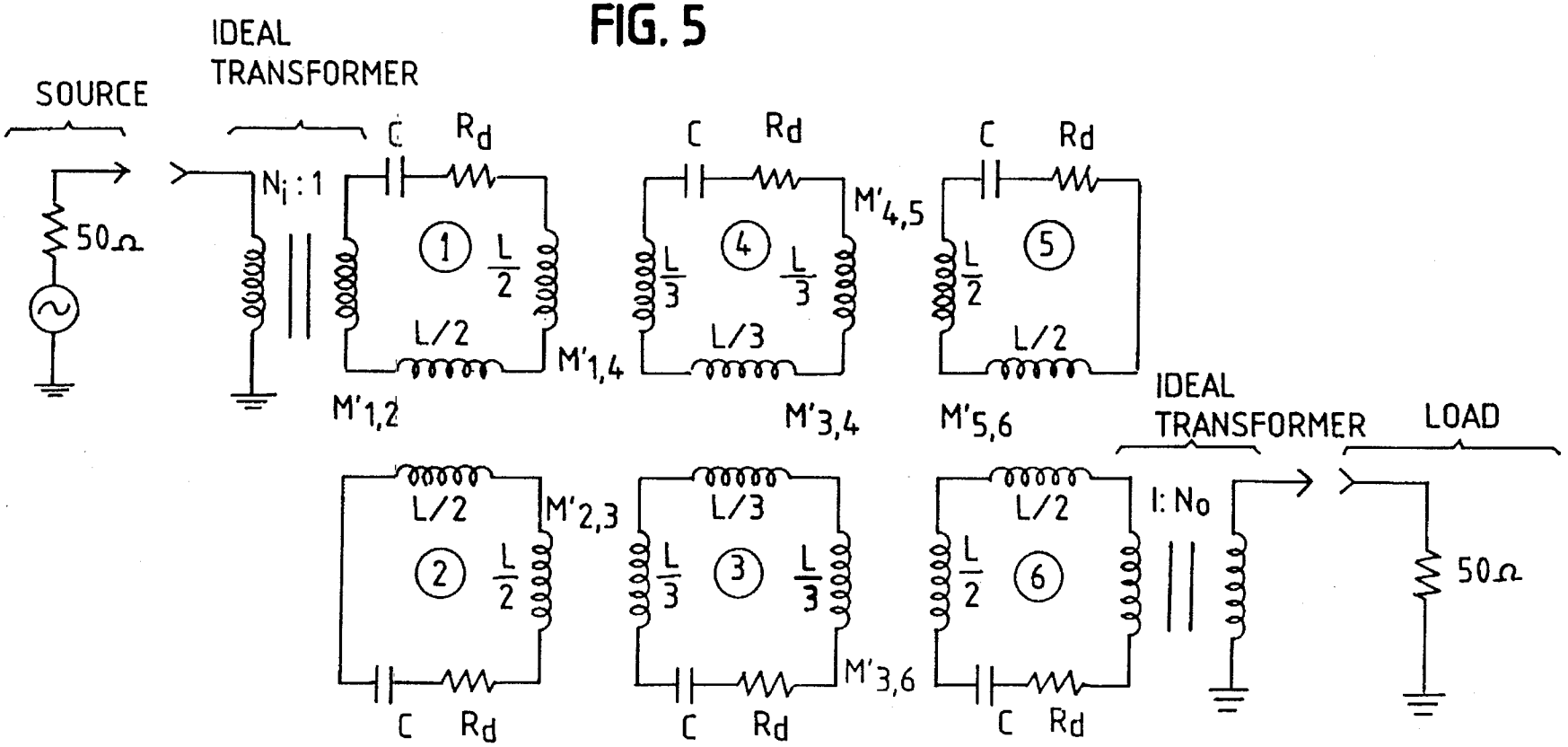
FIG. 5 is a schematic diagram of an equivalent circuit for the filter design of FIG. 4(*c*) and filter embodiment of FIGS. 6(*a*)–(*c*)

An equivalent circuit of design (c) is shown in FIG. 5, where:

$f_c$=845.75 MHz=specified bandpass center frequency of the bandpass filter;

bw=1.54 MHz=specified bandpass bandwidth of the bandpass filter;

R=50 ohms=specified source and load impedance of the bandpass filter;

$Q_u$=26000=each resonance's estimated unloaded Q;

$fbw=bw/f_c$=0.182%="fractional" bandwidth of bandpass filter;

$\omega_c=1/(L\ C)^{1/2}=2\ \pi f_c$=5314003973.55=passband center frequency in radians;

$R_d=1/Q_u$=each resonance's estimated decrement;

$M_{x,y}$=normalized coupling coefficient;

$K_{x,y}=M_{x,y}$ fbw=unnormalized coupling coefficient;

$M'_{x,y}=K_{x,y}/\omega_c$=unnormalized mutual inductance;

$R_i$, $R_o=R_{ni}$ fbw, $R_{no}$fbw=unnormalized input and output impedances, respectively;

$Q_{ei}$, $Q_{eo}=1/R_i$, $1/R_o$=unnormalized input and output external Q's, respectively;

and the normalized circuit parameters are:

$R_{ni}$=1.192839, $R_{no}$=0.990822;

$M_{1,2}$=0.252577, $M_{2,3}$=−1.051914, $M_{3,4}$=0.672315, $M_{4,5}$=−0.725129, $M_{1,4}$=1.051914, $M_{5,6}$=0.672315, $M_{3,6}$=0.725129 and the unnormalized circuit parameters are:

$N_i=(R/R_i)^{1/2}$=151.724=input transformer turns ratio;

$M'_{1,2}=86.5467\times10^{-15}$, $M'_{2,3}=-360.443\times10^{-15}$ $M'_{3,4}=230.372\times10^{-15}$, $M'_{4,5}=-248.469\times10^{-15}$ $M'_{5,6}=M'_{3,4}$, $M'_{1,4}=-M'_{2,3}$, $M'_{3,6}=-M'_{4,5}$ $N_o=(R/R_o)^{1/2}$=166.475=output transformer turns ratio;

and alternative unnormalized circuit parameters are:

$Q_{ei}$=460.40438960, $Q_{eo}$=554.27545178

$K_{1,2}$=0.000459910, $K_{2,3}$=−0.001915398, $K_{3,4}$=0.001224198, $K_{4,5}$=−0.001320365, $K_{5,6}=K_{3,4}$, $K_{1,4}=-K_{2,3}$, $K_{3,6}=-K_{4,5}$

The calculated performance of this circuit is just that already shown in FIGS. 2 and 3.

Figure 6A:
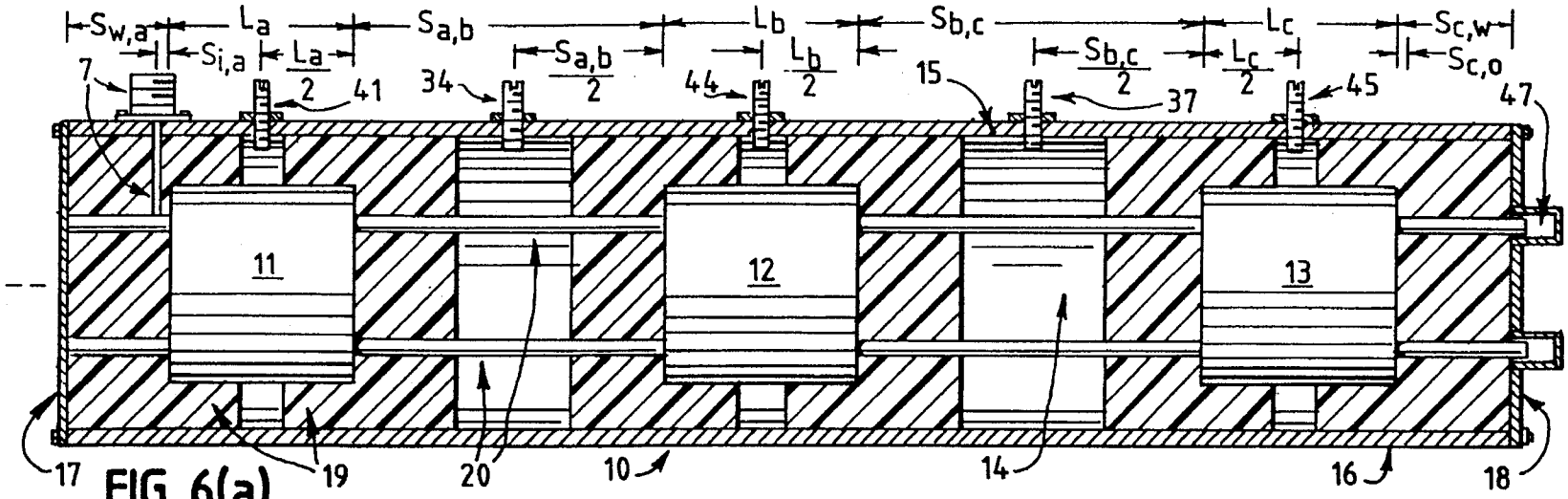
FIG. 6(*a*) is a cross-sectional side view of a longitudinal dual-mode dielectric resonator filter embodiment, without irises.
Figure 6B:
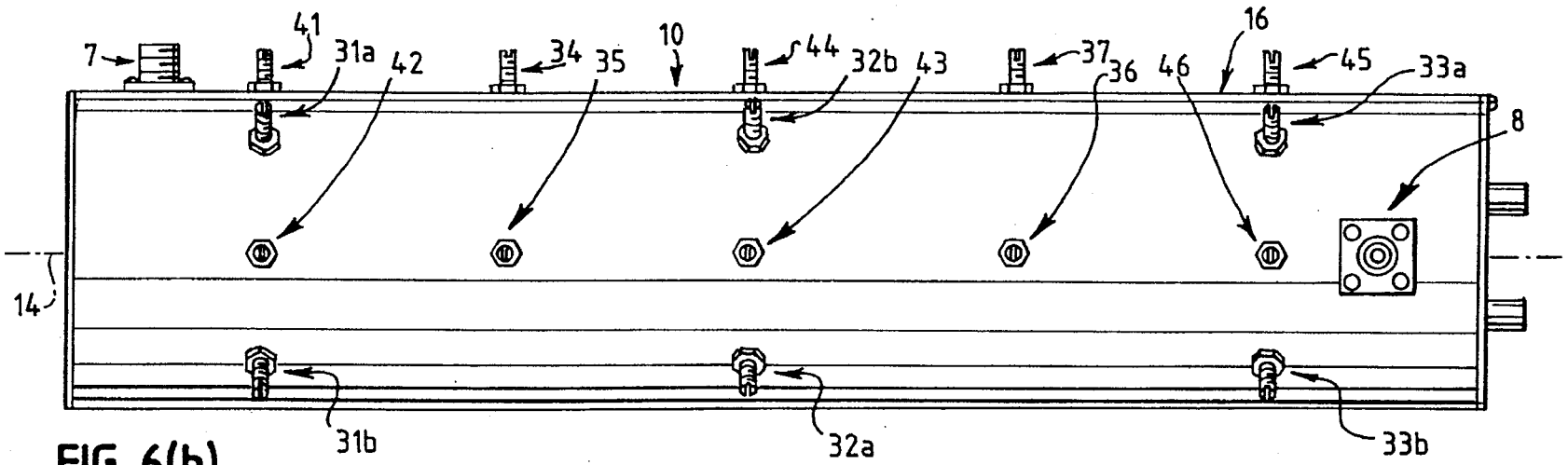
Figure 6C:
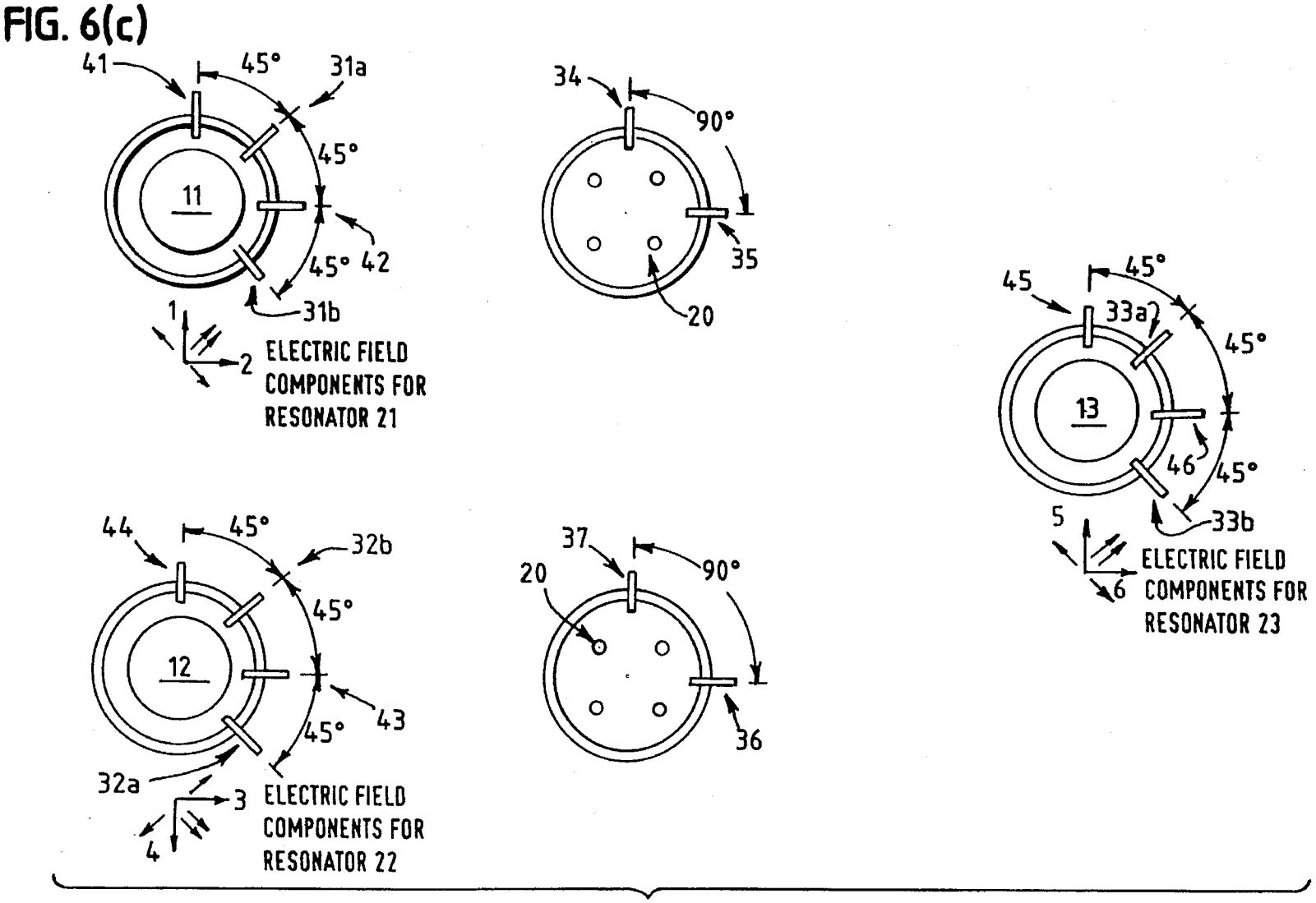

A detailed drawing of the dual-mode dielectric resonator implementation 10 of filter design (c) is shown in FIG. 6(*a*)–(*c*). Again, the filter 10 consists of first, second, and third circular cylindrical, high dielectric constant, ceramic elements, 11, 12, and 13, respectively, which are disposed within, and share a common axis 14 with, the circular cylindrical conductive cavity 15. A suitable ceramic material for 11, 12, and 13 is a low loss (low dielectric loss tangent) Barium Titanate ($BaO/TiO_2$) ceramic with a dielectric constant of approximately 34 and a temperature coefficient of frequency, $\tau_f$, of approximately zero. In this example, the ceramics 11, 12, 13 have an outer diameter of 2.72 inches, while their thicknesses are 2.65, 2.67, and 2.65 inches respectively. The cavity can be constructed in any of a number of ways. Here, it consists of a single central copper tube 16 (20 inches long, 4.5 inches in outer diameter, and with 0.25 inch thick walls) with copper end plates 17 and 18 screwed on to and covering each end.

The ceramic elements 11, 12, 13 are supported within the cavity 15, and are preferably separated from its conductive surfaces, by additional low loss dielectric material, such as the polystyrene foam 19 and the 0.25 inch diameter quartz glass rods 20 used in this example. The foam supports 19 act to center the resonators in the cavity tube 16 while aligning the axes of the resonators with the cavity's axis 14. The quartz rod supports 20 act to space the ceramic elements from the cavity end plates 17, 18, and from each other, with precision. In this example, we have chosen to use four rods in each longitudinal space, and their positions and orientations can be observed in FIGS. 6(*a*)–6(*c*) (their cross-sections are centered on a 2.465 inch diameter circle which is itself centered on the cavity's axis 14). It is important to note that the material, shape, number, position, and orientation of the support elements could just as easily be different without straying from the spirit of the present invention. The edge-to-edge spacing $S_{w,a}$ from end plate 17 to ceramic 11 is 1.399 inches. The edge-to-edge spacing $S_{a,b}$ from ceramic 11 to 12 is 4.310 inches. The edge-to-edge spacing $S_{b,c}$ from ceramic 12 to 13 is 4.813 inches. And the edge-to-edge spacing $S_{c,w}$ from ceramic 13 to end plate 18 is 1.508 inches. To help maintain the mechanical integrity of the filter assembly 10 when it is subjected to mechanical and environmental stress, the entire quartz and ceramic subassembly is spring loaded with conventional steel coil springs 47 recessed into metal cups in end plate 18, one at the plate end of each of the four quartz rods in space $S_{c,w}$. Again, it is important to note that the method of spring loading could be altered, or eliminated altogether, without deviating from the spirit of the present invention. The ceramic elements, together with the cavity and the supports, form what are conventionally known as $HEH_{11}$ dual-mode dielectric resonators. One of such resonators 21, 22, 23 is associated with each of the ceramic elements 11, 12, 13 respectively. Note that recessing the springs in end plate 18 helps to minimize their effect on the resonant frequencies and unloaded Q of resonator 23.

Again, as demonstrated in FIGS. 1(*a*) and 1(*b*), each dual-mode dielectric resonator 21, 22, 23 can be characterized as having two resonances, denoted by their electric field axes 1 and 2, 3 and 4, and 5 and 6, respectively, at similar frequencies, which are mutually orthogonal to each other and to the filter's common axis 14, and whose resonant frequencies are determined to various extents by the size and shape of the cavity and the size, shape, location, and various material properties of all of the materials within the cavity (including supports, coupling tuning mechanisms, and signal input and output mechanisms).

As it is both difficult and expensive to control any of these parameters precisely enough to guarantee unadjusted resonant frequencies accurate enough for this narrow-band application, conductive metal screws 41, 42, 43, 44, 45, 46 are used to (relatively) independently adjust, or tune, the resonant frequencies of resonances 1, 2, 3, 4, 5, 6, respectively. These frequency tuning screws are placed through the cavity wall 16, generally toward the central axis 14 of the ceramic element, and predominately along each resonant mode's electric field main axis. As the penetration of a frequency tuning screw into the cavity is increased, the frequency of the associated $HEH_{11}$ mode is lowered. As the screw is retracted from the cavity, the associated mode's frequency is raised. The frequency tuning screws can be placed in a variety of locations and orientations, but they will have a greater effect on a mode's frequency if they are placed (as shown) where that mode's electric field is stronger. Also, it is generally desirable to have each mode's frequency as independent as possible from the frequency adjustment mechanisms of other mode's, so, consequently, it is desirable to place a mode's frequency tuning screw in a location where the electric fields of other modes are weak.

If all of the shapes, positions, and compositions of the materials of filter 10 were ideal, there would be negligible coupling (i.e., indra-resonator coupling) between the orthogonal modes on each resonator. Intra-resonator coupling can be introduced by creating an asymmetry between two adjacent quadrants of a dual-mode resonator. Further, this coupling can be defined to have a certain polarity, depending on which quadrant has the dominant asymmetry. As discussed in Ragan, one way to create such an asymmetry is to place a conductive metal intra-resonator coupling screw in the same plane as the two mode frequency tuning screws, which are at 90 degrees to each other, but oriented 45 degrees off from the axes of those screws. Screw pairs 31, 32, 33 act as intra-resonator mode coupling screws to realize coupling coefficients $K_{1,2}$, $K_{3,4}$, $K_{5,6}$, respectively. By itself, the deeper the penetration of such a coupling screw into the cavity, the greater the intra-resonator mode coupling. However, another screw in the same plane (orthogonal to axis 14), but oriented orthogonally to the first intra-resonator coupling screw, can act to restore symmetry (either in reality or effectively) to the resonator structure and thereby cancel some or all of the intra-resonator coupling created by the first screw. This second screw can even cause the polarity of the coupling to change as it is adjusted to become more dominant. In practice, the shapes, positions, and compositions of the materials of filter 10 are not ideal. Consequently, there is some amount of intra-resonator mode coupling of some polarity inherent in the structure without the use of dedicated intra-resonator mode coupling mechanisms. Therefore, it can be useful to have two orthogonal intra-resonator mode coupling screws associated with each dual-mode resonator, to permit the adjustment of the mode coupling in either an increasing or decreasing manner and in either polarity. In FIGS. 6(*a*)–6(*c*), screws 31*a*, 32*a*, 33*a* are those called for by design (c), while their complementary, orthogonal screws 31*b*, 32*b*, and 33*b* may be desired to fine tune their respective intra-resonator couplings or to compensate for an inherent offset in the couplings due to imperfections in the materials or manufacturing process.

In this example the filter has been designed for 50 ohm source and load impedances. The input signal is applied to the filter via a female, flat-flange, non-captured teflon, N-type connector and probe assembly 7. Inside the cavity, the center pin of the N-type connector is attached to a 0.08 inch diameter straight copper wire. The probe extends along a radial line parallel to the electric field axis of resonance 1, in a plane orthogonal to the filter's central axis 14, centered at an offset $S_{i,a}$ of 0.125 inch from the leading edge of ceramic 11, and with a length of 1.417 inches from the connector flange. The output signal is extracted from the filter via a similar female, flat-flange, non-captured teflon, N-type connector and probe assembly 8. Inside the cavity, the center pin of the N-type connector is attached to a 0.08 inch diameter straight copper wire. The probe extends along a radial line parallel to the electric field axis of resonance 6, in a plane orthogonal to the filter's central axis 14, centered at an offset $S_{c,o}$ of 0.125 inch from the trailing edge of ceramic 13, and with a length of 1.425 inches from the connector flange. It is generally necessary to adjust the length of both of these probes slightly during the tuning process in order to optimize the response of this very narrow band filter. The amount of coupling, or external Q, of each probe is controlled by many things, including their relative position and orientation, depth of cavity penetration, proximity to resonator ceramics, shape, size (thickness or diameter), length, and their surrounding cavity environment.

Since no irises or coupling obstacles have been used in this example, the spacings $S_{a,b}$ and $S_{b,c}$ between the ceramics are the primary physical parameters determining the inter-resonator coupling coefficients $K_{1,4}$, $K_{2,3}$ and the $K_{3,6}$, $K_{4,5}$, respectively. Given these coupling coefficients, these spacings may be designed by using the mode matching methods referenced by Zaki or Kobayashi, by other numerical methods, such as finite difference or finite element analysis, or by empirical methods, such as by design charts derived from laboratory measurements. Since fabrication process and economic limitations generally due not permit accurate and repeatable enough realizations of these couplings, inter-resonator mode coupling screws 34, 35, 36, 37 are made available to tune the couplings $K_{1,4}$, $K_{2,3}$, $K_{3,6}$, $K_{4,5}$ respectively. In this example, the spacings were developed for coupling values a few percent less than the designed values, and the screws 34, 35, 36, 37 were sized to allow for a 10% tuning range for the inter-resonator couplings.

Tuning is generally one of the most difficult aspects of realizing dual-mode dielectric resonator filters. The filter 10 can be tuned following the analytical methods of A. E. Atia and A. E. Williams in "Measurements of intercavity couplings," *IEEE Trans. Microwave Theory Tech.*, vol. MTT-23, pp. 519–522, June 1975, or of M. H. Chen in "Short-Circuit Tuning Method for Singly Terminated Filters," *IEEE Trans. Microwave Theory Tech.*, vol. MTT-25, No. 12, pp.

Figure 7:
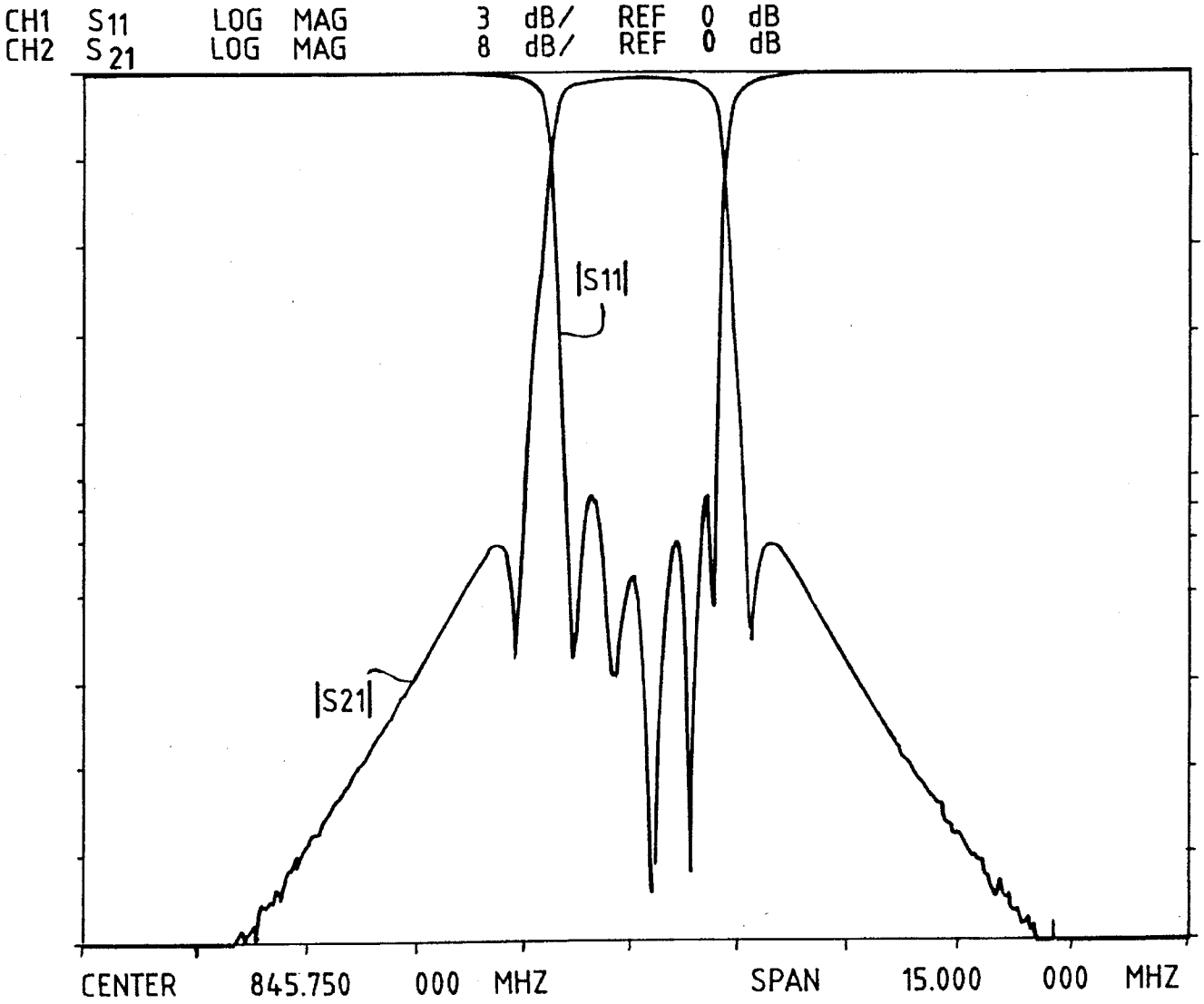
FIG. 7 is a graph showing the measured insertion loss (|S21|) and return loss (|S11|) over the frequency range of 838.25 MHz to 853.25 MHz for the filter embodiment of FIGS. 6(*a*)–6(*c*)
Figure 8:
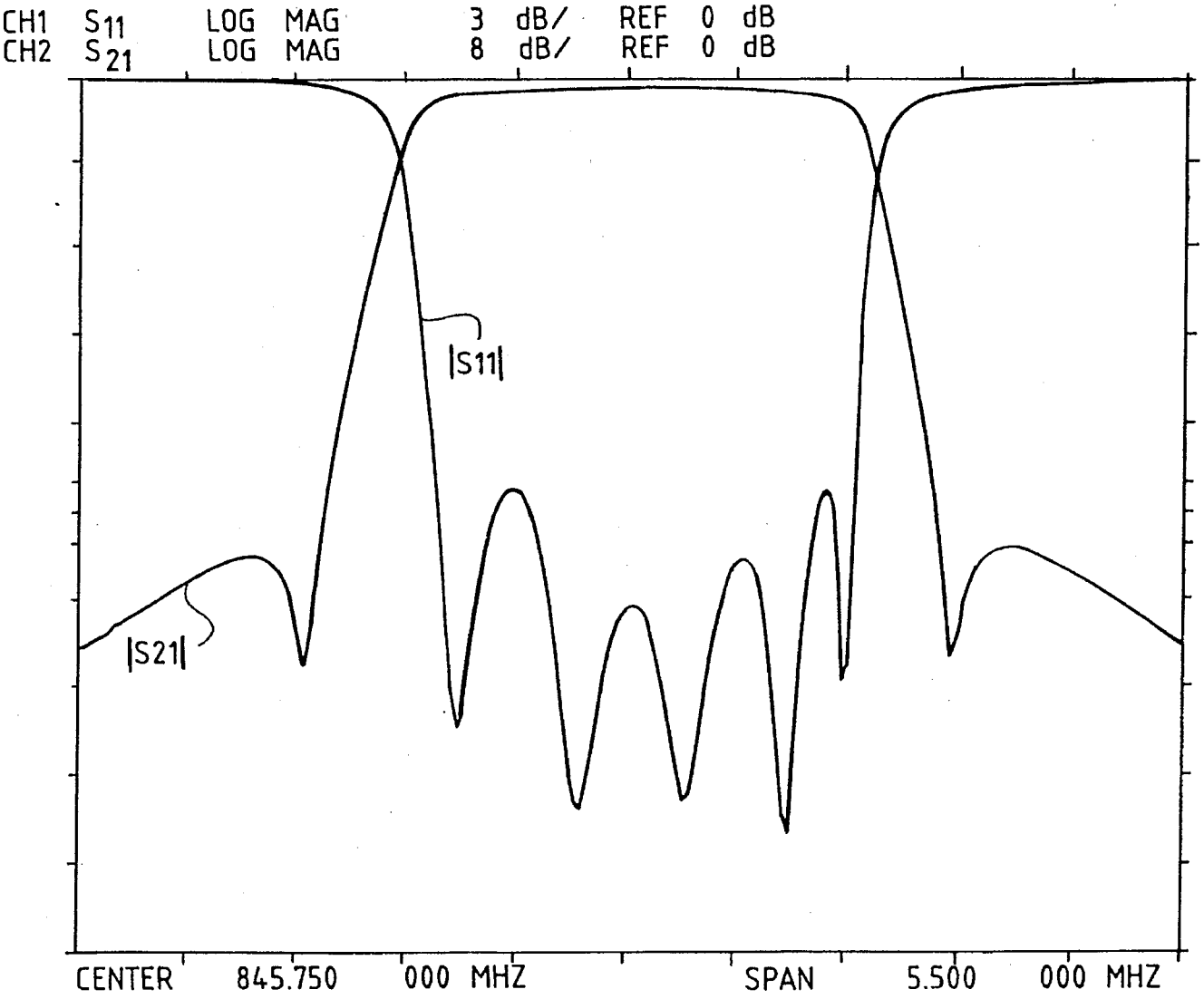
FIG. 8 is a graph showing the measured insertion loss (|S21|) and return loss (|S11|) over the frequency range of 843 MHz to 848.5 MHz for the filter embodiment of FIGS. 6(*a*)–6(*c*).

1032–1036, December 1977, and/or by an organized, iterative trial-and-error empirical tuning approach. However, an alternative, rather easy, approach is to develop a graphical tuning procedure using a circuit simulator to generate a series of single-port s-parameter (S11 magnitude plus angle, or Smith Chart, and S11 magnitude, or Return Loss) plots starting with just the input or output port and progressively coupling additional elements into the circuit, until at least halfway through the circuit, and then repeating the process from the other port. With a real filter, simply follow the same sequence as the probes, frequency tuning screws, intra-resonator coupling screws, and inter-resonator coupling tuning screws are adjusted one by one. Even following the analytical or graphical approaches, it is generally necessary to repeat the whole procedure one or more times, and then finish with some empirical adjustments. A measured plot of the manufactured filters |S21| (Insertion Loss) and |S11| (Return Loss) performance is shown in FIGS. 7 and 8, which compares favorably with the computed performance in FIGS. 2 and 3.

Although the above description provides a realization of a dual-mode dielectric resonator filter having no iris, thereby eliminating parts, in other applications, for instance where volume is even more critical, or for other performance requirements for which such equal inter-resonator couplings do not occur, decoupling obstacles and/or irises could be added without deviating from the intended scope of this patent.

Also, although the above description applies to a dual-mode filter satisfying certain design goals, such as achieving relatively large and approximately equal inter-resonator coupling coefficients, other types of filters satisfying other unique design goals which are discernable from an applicable design space plot are to be considered within the intended scope of this patent. For instance, referring back to the previous design example and FIG. 4, if it is most preferable to minimize the maximum number of couplings to any given resonant mode in order to simplify the tuning procedure during manufacturing and thereby reduce manufacturing costs, then one could choose a design corresponding to $0_{2,4}=29°$ for which $M_{3,4}=0$, thereby reducing the number of couplings associated with resonances 3 and 4 from three to two, and for which the paired inter-resonator couplings are still similar in magnitude and where their smallest magnitude is still several times larger than that for the traditional dual-mode longitudinal design.

Finally, although the above description relates to six resonance filters, the design method applies to filters with other numbers of resonances as well. Take, for example, an eight resonance filter, which has an 8 by 8 square matrix of resonator coupling coefficients of the form:

$$m=\begin{matrix} 0 & m_{1,2} & 0 & 0 & 0 & 0 & 0 & 0 \\ m_{2,1} & 0 & m_{2,3} & 0 & 0 & 0 & m_{2,7} & 0 \\ 0 & m_{3,2} & 0 & m_{3,4} & 0 & m_{3,6} & 0 & 0 \\ 0 & 0 & m_{4,3} & 0 & m_{4,5} & 0 & 0 & 0 \\ 0 & 0 & 0 & m_{5,4} & 0 & m_{5,6} & 0 & 0 \\ 0 & 0 & m_{6,3} & 0 & m_{6,5} & 0 & m_{6,7} & 0 \\ 0 & m_{7,2} & 0 & 0 & 0 & m_{7,6} & 0 & m_{7,8} \\ 0 & 0 & 0 & 0 & 0 & 0 & m_{8,7} & 0 \end{matrix}$$

which satisfies a pre-determined power transfer characteristic. An ordered set of plane rotation matrices $\{R_{4,6}, R_{2,4}, R_{3,5}, R_{5,7}\}$, can be selected, and a sequence of orthogonal similarity transformation updates can be performed on the coupling coefficient matrix, m, such that $$M_n=M_4=M=R_{5,7}\cdot R_{3,5}\cdot R_{2,4}\cdot R_{4,6}\cdot m\cdot R_{4,6}^T\cdot R_{2,4}^T\cdot R_{5,7}^T,$$

where the result is $$M=\begin{matrix} 0 & M_{1,2} & 0 & M_{1,4} & 0 & M_{1,6} & 0 & 0 \\ M_{2,1} & 0 & M_{2,3} & 0 & M_{2,5} & 0 & M_{2,7} & 0 \\ 0 & M_{3,2} & 0 & M_{3,4} & 0 & M_{3,6} & 0 & M_{3,8} \\ M_{4,1} & 0 & M_{4,3} & 0 & M_{4,5} & 0 & M_{4,7} & 0 \\ 0 & M_{5,2} & 0 & M_{5,4} & 0 & M_{5,6} & 0 & M_{5,8} \\ M_{6,1} & 0 & M_{6,3} & 0 & M_{6,5} & 0 & M_{6,7} & 0 \\ 0 & M_{7,2} & 0 & M_{7,4} & 0 & M_{7,6} & 0 & M_{7,8} \\ 0 & 0 & M_{8,3} & 0 & M_{8,5} & 0 & M_{8,7} & 0 \end{matrix}$$

If rotation angle $\theta_{4,6}$ of plane rotation matrix $R_{4,6}$ is selected to be an independent variable, and the rotation angles of the other plane rotation matrices are chosen to be:

$$\theta_{2,4}=\tan^{-1}[-m_{2,7}/(m_{6,7}s_{4,6})],$$

$$\theta_{3,5}=\tan^{-1}[(m_{4,5}c_{4,6}+m_{5,6}s_{4,6})t_{2,4}/(m_{2,3}+(m_{3,4}c_{4,6}+m_{3,6}s_{4,6})t_{2,4})],$$

$$\theta_{5,7}=\tan^{-1}[(m_{6,7}s_{4,6}+m_{2,7}t_{2,4})/(c_{3,5}(m_{4,5}c_{4,6}+m_{5,6}s_{4,6})-s_{3,5}((m_{3,4}c_{4,6}+m_{3,6}s_{4,6})-m_{2,3}t_{2,4}))],$$

where:

$s_{x,y}=\sin[\theta_{x,y}]$, $c_{x,y}=\cos[\theta_{x,y}]$, and $t_{x,y}=\tan[\theta_{x,y}]$, then the result of this matrix transformation is $$M=\begin{matrix} 0 & M_{1,2} & 0 & M_{1,4} & 0 & 0 & 0 & 0 \\ M_{2,1} & 0 & M_{2,3} & 0 & 0 & 0 & 0 & 0 \\ 0 & M_{3,2} & 0 & M_{3,4} & 0 & M_{3,6} & 0 & 0 \\ M_{4,1} & 0 & M_{4,3} & 0 & M_{4,5} & 0 & 0 & 0 \\ 0 & 0 & 0 & M_{5,4} & 0 & M_{5,6} & 0 & M_{5,8} \\ 0 & 0 & M_{6,3} & 0 & M_{6,5} & 0 & M_{6,7} & 0 \\ 0 & 0 & 0 & 0 & 0 & M_{7,6} & 0 & M_{7,8} \\ 0 & 0 & 0 & 0 & M_{8,5} & 0 & M_{8,7} & 0 \end{matrix}$$

Having accomplished this transformation, it is then possible to construct a plot of functions of at least some of the elements of the orthogonally transformed coupling coefficient matrix, M, as a function of the independent rotation angle variable, $\theta_{4,6}$, to create a design space plot. From this design space plot, one may then select a preferred filter realization in accordance with some predetermined criterion and construct a filter in accordance with this preferred realization.

It has been demonstrated that conventional filter design methodologies do not lead to designs containing certain desirable qualities, and that, consequently, conventional dual-mode bandpass filter implementations do not embody these desirable qualities. Conversely, it has been demonstrated that filter designs developed in accordance with the present invention do exhibit these desirable qualities, and filter implementations in accordance with the present invention do also embody these desirable properties.

There have been described herein an optimum, multiple signal path, multiple-mode filter and method that are relatively free from the shortcomings of the prior art. It will be apparent to those skilled in the art that modifications may be made without departing from the spirit and scope of the invention. Accordingly, it is not intended that the invention be limited except as may be necessary in view of the appended claims.

What is claimed is:

1. A method for constructing a multiple signal path, frequency spectrum filter, the filter including:

material elements giving rise to at least five resonances at a common frequency, $f_0$;

means for coupling signal energy between at least some of said resonances;

signal input means for coupling an input signal to at least one of said resonances;

signal output means for coupling an output signal from at least one of said resonances;

sequential connections of one or more of said means for coupling signal energy forming signal paths;

at least two signal paths connecting the input means with the output means; and said two signal paths differing in at least one coupling; the method comprising the steps of:

(a) forming a matrix of resonator coupling coefficients, m, representing and satisfying a pre-determined power transfer characteristic;

(b) selecting an ordered set of plane rotation matrices $\{R_{p1,q1}, R_{p2,q2}, \ldots, R_{pn,qn}\}$, with each plane rotation matrix, $R_{pi,qi}$, where i=1,2, . . . , n, a modified identity matrix comprising:

a rotation angle, $\theta_{pi,qi}$;

matrix elements $R_{pi,pi}=R_{qi,qi}=\cos[\theta_{pi,qi}]$;

matrix elements $R_{pi,qi}=(-R_{qi,pi})=\sin[\theta_{pi,qi}]$;

where the subscripts pi and qi of said rotation matrix elements represent the matrix row and column indices, respectively; and where at least one of said rotation angles of said plane rotation matrices is selected as an independent variable;

(c) performing a sequence of ordered orthogonal similarity transformation updates on the coupling coefficient matrix wherein said sequence of orthogonal similarity transformations is of the form:

$$M_i=S(M_{i-1}, R_{pi,qi})\,[R_{pi,qi}^T\cdot M_{i-1}\cdot R_{pi,qi}],$$

where $M_0$=m and i=1, 2, . . . , n, and where $S(M_{i-1}, R_{pi,qi})$ is an orthogonal similarity transformation of coupling coefficient matrix $M_{i-1}$ by said plane rotation matrix $R_{pi,qi}$;

(d) constructing a plot of functions of at least some of the matrix elements of the orthogonally transformed coupling coefficient matrix, $M_n$, as a function of said at least one independent rotation angle variable to create a design space plot;

(e) selecting, in accordance with at least one predetermined criterion, a preferred filter realization, corresponding to a particular value of each of said independent variables, from the design space plot; and (f) constructing a filter in accordance with the preferred filter realization.

2. The method in accordance with claim 1, wherein performing said sequence of ordered orthogonal similarity transformation updates on the coupling coefficient matrix comprises a sequence of matrix multiplications of the form $$M_i=R_{pi,qu}^T\cdot M_{i-1}\cdot R_{pi,qi}$$

where $R_{pi,qi}^T$ is the transpose of $R_{pi,qi}$, $M_0$=m, and i=1, 2, . . . , n.

3. The method in accordance with claim 2, wherein said filter has six resonances;

the matrix of resonator coupling coefficients is a 6 by 6 square matrix of the form:

$$m=\begin{matrix} 0 & m_{1,2} & 0 & m_{1,4} & 0 & 0 \\ m_{2,1} & 0 & m_{2,3} & 0 & m_{2,5} & 0 \\ 0 & m_{3,2} & 0 & m_{3,4} & 0 & m_{3,6} \\ m_{4,1} & 0 & m_{4,3} & 0 & m_{4,5} & 0 \\ 0 & m_{5,2} & 0 & m_{5,4} & 0 & m_{5,6} \\ 0 & 0 & m_{6,3} & 0 & m_{6,5} & 0 \end{matrix};$$

the selected ordered set of said plane rotation matrices is $\{R_{3,5}, R_{2,4}\}$;

the said orthogonal similarity transformation performed is:

$$M_n=M_2=M=R_{2,4}^T\cdot R_{3,5}^T\cdot m\cdot R_{3,5}\cdot R_{2,4}$$

where the result is:

$$M=\begin{matrix} 0 & M_{1,2} & 0 & M_{1,4} & 0 & 0 \\ M_{2,1} & 0 & M_{2,3} & 0 & M_{2,5} & 0 \\ 0 & M_{3,2} & 0 & M_{3,4} & 0 & M_{3,6} \\ M_{4,1} & 0 & M_{4,3} & 0 & M_{4,5} & 0 \\ 0 & M_{5,2} & 0 & M_{5,4} & 0 & M_{5,6} \\ 0 & 0 & M_{6,3} & 0 & M_{6,5} & 0 \end{matrix};$$

and where the elements of the orthogonally transformed resonator coupling coefficient matrix are:

$$M_{1,2}=m_{1,2}c_{2,4}-m_{1,4}s_{2,4};$$

$$M_{2,3}=m_{2,3}c_{2,4}c_{3,5}-m_{3,4}s_{2,4}c_{3,5}+m_{4,5}s_{2,4}s_{3,5}-m_{2,5}c_{2,4}s_{3,5},$$

$$M_{3,4}=m_{2,3}s_{2,4}c_{3,5}+m_{3,4}c_{2,4}c_{3,5}-m_{4,5}c_{2,4}s_{3,5}-m_{2,5}s_{2,4}s_{3,5},$$

$$M_{4,5}=m_{2,3}s_{2,4}s_{3,5}+m_{3,4}c_{2,4}s_{3,5}+m_{4,5}c_{2,4}c_{3,5}+m_{2,5}s_{2,4}c_{3,5},$$

$$M_{5,6}=m_{3,6}s_{3,5}+m_{5,6}c_{3,5};$$

$$M_{1,4}=m_{1,4}c_{2,4}+m_{1,2}s_{2,4};$$

$$M_{2,5}=m_{2,3}c_{2,4}s_{3,5}-m_{3,4}s_{2,4}s_{3,5}-m_{4,5}s_{2,4}c_{3,5}+m_{2,5}c_{2,4}c_{3,5},$$

$$M_{3,6}=m_{3,6}c_{3,5}-m_{5,6}s_{3,5},$$

$$s_{x,y}=\sin[\theta_{x,y}],$$

$$c_{x,y}=\cos[\theta_{x,y}], \text{ and}$$

$$m_{x,y}=m_{y,x} \text{ and } M_{x,y}=M_{y,x}.$$

4. The method in accordance with claim 3, wherein rotation angle $\theta_{2,4}$ of plane rotation matrix $R_{2,4}$ is one of said independent variables, and where the rotation angle of plane rotation matrix $R_{3,5}$ is:

$$\theta_{3,5}=\arctan[-(m_{2,5}-m_{4,5}\tan[\theta_{2,4}])/(m_{2,3}-m_{3,4}\tan[\theta_{2,4}])],$$

where the result of said matrix transformation is $$M=\begin{matrix} 0 & M_{1,2} & 0 & M_{1,4} & 0 & 0 \\ M_{2,1} & 0 & M_{2,3} & 0 & 0 & 0 \\ 0 & M_{3,2} & 0 & M_{3,4} & 0 & M_{3,6} \\ M_{4,1} & 0 & M_{4,3} & 0 & M_{4,5} & 0 \\ 0 & 0 & 0 & M_{5,4} & 0 & M_{5,6} \\ 0 & 0 & M_{6,3} & 0 & M_{6,5} & 0 \end{matrix}$$

5. The method in accordance with claim 4, wherein said selection of a preferred filter realization includes selecting values of each of said independent variables from said design space plot such that the magnitudes $M_{1,2}$, $M_{3,4}$, and $M_{5,6}$ are less than the magnitudes of $M_{2,3}$, $M_{4,5}$, $M_{1,4}$ and $M_{3,6}$.

6. The method in accordance with claim 4, wherein said selection of a preferred filter realization includes selecting values of each of said independent variables from said design space plot such that the magnitudes of $M_{2,3}$ and $M_{1,4}$ are approximately equal and the magnitudes of $M_{4,5}$ and $M_{3,6}$ are approximately equal.

7. The method in accordance with claim 4, wherein said selection of a preferred filter realization includes selecting values of each of said independent variables from said design space plot such that the magnitude of $M_{3,4}$ is approximately equal to zero, and is at least orders of magnitude less than the other said non-zero coupling coefficients.

8. The method in accordance with claim 1, wherein said resonant elements comprise dual-mode resonators having two mutually perpendicular resonant modes.

9. The method in accordance with claim 8, wherein said dual-mode resonators are dual-mode dielectric resonators and said dual-mode filter constructed in accordance with said preferred realization comprises:

a cut-off waveguide having an axis;

first, second, and third dual-mode dielectric resonators disposed in said waveguide and spaced apart along said axis;

said first resonator having first and second mutually perpendicular resonance modes;

said second resonator having third and fourth mutually perpendicular resonance modes;

said third resonator having fifth and sixth mutually perpendicular resonance modes;

said first and fourth resonances being mutually parallel;

said second and third resonances being mutually parallel;

said third and sixth resonances being mutually parallel;

and said fourth and fifth resonances being mutually parallel;

means for adjusting the frequency of said first, second, third, fourth, fifth, and sixth resonance modes;

said signal input means coupling energy into said first resonance mode of said first resonator;

said signal output means coupling energy out of said sixth resonance mode of said third resonator;

means for controllably coupling the first and second orthogonal resonance modes, the third and fourth orthogonal resonance modes, and the fifth and sixth orthogonal resonance modes;

means for controllably coupling the first and fourth parallel resonances, the second and third parallel resonances, the third and sixth parallel resonances, and the fourth and fifth parallel resonances.

10. The method in accordance with claim 1, wherein performing said sequence of ordered orthogonal similarity transformation updates on the coupling coefficient matrix comprises a sequence of matrix multiplications of the form $$M_i=R_{pi,qi}\cdot M_{i-1}\cdot R_{pi,qi}^{T}$$

where $R_{pi,qi}^{T}$ is the transpose of $R_{pi,qi}$, $M_0$=m, and i=1, 2, . . . , n.

11. The method in accordance with claim 1, wherein said plot is of a function of said matrix elements of said orthogonally transformed coupling coefficient matrix as a function of at least one of said rotation angles.

12. The method in accordance with claim 1, wherein said plot is of the magnitudes of said matrix elements of said orthogonally transformed coupling coefficient matrix as a function of at least one of said rotation angles.

13. A method for constructing an eight resonance, multiple signal path, frequency spectrum filter, the method comprising the steps of:

(a) forming a matrix of resonator coupling coefficients, m, representing and satisfying a predetermined power transfer characteristic, where m is given by $$m=\begin{matrix} 0 & m_{1,2} & 0 & 0 & 0 & 0 & 0 & 0 \\ m_{2,1} & 0 & m_{2,3} & 0 & 0 & 0 & m_{2,7} & 0 \\ 0 & m_{3,2} & 0 & m_{3,4} & 0 & m_{3,6} & 0 & 0 \\ 0 & 0 & m_{4,3} & 0 & m_{4,5} & 0 & 0 & 0 \\ 0 & 0 & 0 & m_{5,4} & 0 & m_{5,6} & 0 & 0 \\ 0 & 0 & m_{6,3} & 0 & m_{6,5} & 0 & m_{6,7} & 0 \\ 0 & m_{7,2} & 0 & 0 & 0 & m_{7,6} & 0 & m_{7,8} \\ 0 & 0 & 0 & 0 & 0 & 0 & m_{8,7} & 0 \end{matrix};$$

(b) selecting an ordered set of plane rotation matrices $\{R_{4,6}, R_{2,4}, R_{3,5}, R_{5,7}\}$;

(c) performing a sequence of orthogonal similarity transformation updates on the coupling coefficient matrix, m, such that $$M_n=M_4=M=R_{5,7}\cdot R_{3,5}\cdot R_{2,4}\cdot R_{4,6}\cdot m\cdot R_{4,6}^{T}\cdot R_{2,4}^{T}\cdot R_{3,5}^{T}\cdot R_{5,7}^{T}$$

where the resulting transformed coupling coefficient matrix is $$M=\begin{matrix} 0 & M_{1,2} & 0 & M_{1,4} & 0 & M_{1,6} & 0 & 0 \\ M_{2,1} & 0 & M_{2,3} & 0 & M_{2,5} & 0 & M_{2,7} & 0 \\ 0 & M_{3,2} & 0 & M_{3,4} & 0 & M_{3,6} & 0 & M_{3,8} \\ M_{4,1} & 0 & M_{4,3} & 0 & M_{4,5} & 0 & M_{4,7} & 0 \\ 0 & M_{5,2} & 0 & M_{5,4} & 0 & M_{5,6} & 0 & M_{5,8} \\ M_{6,1} & 0 & M_{6,3} & 0 & M_{6,5} & 0 & M_{6,7} & 0 \\ 0 & M_{7,2} & 0 & M_{7,4} & 0 & M_{7,6} & 0 & M_{7,8} \\ 0 & 0 & M_{8,3} & 0 & M_{8,5} & 0 & M_{8,7} & 0 \end{matrix}$$

(d) selecting at least one rotation angle of one of said plane rotation matrices as an independent variable;

(e) constructing a plot of functions of at least some of the elements of the orthogonally transformed coupling coefficient matrix, M4, as a function of said independent variable to create a design space plot;

(f) selecting, in accordance with at least one predetermined criterion, a preferred filter realization, corresponding to a particular value of each of said independent variables, from the design space plot; and (g) constructing a filter in accordance with said preferred filter realization.

14. The method in accordance with claim 13, wherein rotation angle $\theta_{4,6}$ of plane rotation matrix $R_{4,6}$ is one of said independent variables, and where the rotation angles of the other plane rotation matrices are:

$$\theta_{2,4}=\tan^{-1}[-m_{2,7}/(m_{6,7}s_{4,6})],$$

$$\theta_{3,5}=\tan^{-1}[(m_{4,5}c_{4,6}+m_{5,6}s_{4,6})t_{2,4}/(m_{2,3}+(m_{3,4}c_{4,6}+m_{3,6}s_{4,6})t_{2,4})],$$

$$\theta_{5,7}=\tan^{-1}[(m_{6,7}s_{4,6}+m_{2,7}t_{2,4})/(c_{3,5}(m_{4,5}c_{4,6}+m_{5,6}s_{4,6})-s_{3,5}((m_{3,4}c_{4,6}+m_{3,6}s_{4,6})-m_{2,3}t_{2,4}))],$$

where:

$s_{x,y}=\sin[\theta_{x,y}]$, $c_{x,y}=\cos[\theta_{x,y}]$, $t_{x,y}=\tan[\theta_{x,y}]$, and where the result of said matrix transformation is $$M=\begin{matrix} 0 & M_{1,2} & 0 & M_{1,4} & 0 & 0 & 0 & 0 \\ M_{2,1} & 0 & M_{2,3} & 0 & 0 & 0 & 0 & 0 \\ 0 & M_{3,2} & 0 & M_{3,4} & 0 & M_{3,6} & 0 & 0 \\ M_{4,1} & 0 & M_{4,3} & 0 & M_{4,5} & 0 & 0 & 0 \\ 0 & 0 & 0 & M_{5,4} & 0 & M_{5,6} & 0 & M_{5,8} \\ 0 & 0 & M_{6,3} & 0 & M_{6,5} & 0 & M_{6,7} & 0 \\ 0 & 0 & 0 & 0 & 0 & M_{7,6} & 0 & M_{7,8} \\ 0 & 0 & 0 & 0 & M_{8,5} & 0 & M_{8,7} & 0 \end{matrix}$$

15. A microwave dual-mode bandpass filter comprising:

first, second, and third dual-mode microwave resonators spaced along a common first axis in a shared conductive enclosure, each exhibiting a first and a second mutually perpendicular resonance mode wherein both of said modes are oriented perpendicularly to said first axis, and wherein said first modes of each resonator are oriented along a common first plane and said second modes of each resonator are oriented along a common second plane orthogonal to said first plane, such that all first modes are mutually parallel and all second modes are mutually parallel;

tuning means for adjusting the resonant frequencies of at least some of said resonance modes;

mode coupling means for causing a first mutual coupling of energy between said orthogonal first and second resonances of said first resonator;

mode coupling means for causing a second mutual coupling of energy between said orthogonal first and second resonances of said second resonator;

mode coupling means for causing a third mutual coupling of energy between said orthogonal first and second resonances of said third resonator;

mode coupling means for causing a fourth mutual coupling of energy between said parallel first resonances of said first and second resonators;

mode coupling means for causing a fifth mutual coupling of energy between said parallel second resonances of said first and second resonators;

mode coupling means for causing a sixth mutual coupling of energy between said parallel first resonances of said second and third resonators;

mode coupling means for causing a seventh mutual coupling of energy between said parallel second resonances of said second and third resonators;

input means for coupling microwave energy into at least one of said resonances of said first resonator;

output means for coupling a portion of said microwave energy out of at least one of said resonances of said third resonator;

wherein the magnitudes of each of said mutual couplings of orthogonal resonances are less than the magnitudes of each of said mutual couplings of parallel resonances.

16. The filter of claim 15, wherein said microwave dual-mode resonators are dual-mode dielectric resonators, with high dielectric constant, high Q ceramic material disposed within said shared conductive enclosure.

17. The filter of claim 16, wherein said resonance modes are $HEH_{11}$ dual hybrid modes.

18. The filter of claim 15, wherein at least some of said mode coupling means include tuning means for controllably and adjustably coupling said resonances.

19. The filter of claim 15, wherein said input means comprises a probe fixed to and penetrating into said shared conductive enclosure and principally coupling to said first resonance of said first resonator.

20. The filter of claim 15, wherein said output means comprises a probe fixed to and penetrating into said shared conductive enclosure and principally coupling to said second resonance of said third resonator.

21. The filter of claim 15, wherein said shared conductive enclosure is a circular cross-section cut-off waveguide cylinder.

22. A microwave dual-mode bandpass filter comprising:

first, second, and third dual-mode microwave resonators spaced along a common first axis in a shared conductive enclosure, each exhibiting a first and a second mutually perpendicular resonance mode wherein both of said modes are oriented perpendicularly to said first axis, and wherein said first modes of each resonator are oriented along a common first plane and said second modes of each resonator are oriented along a common second plane orthogonal to said first plane, such that all first modes are mutually parallel and all second modes are mutually parallel;

tuning means for adjusting the resonant frequencies of each of said resonance modes;

mode coupling means for causing a first mutual coupling of energy between said orthogonal first and second resonances of said first resonator;

mode coupling means for causing a second mutual coupling of energy between said orthogonal first and second resonances of said second resonator;

mode coupling means for causing a third mutual coupling of energy between said orthogonal first and second resonances of said third resonator;

mode coupling means for causing a fourth mutual coupling of energy between said parallel first resonances of said first and second resonators:

mode coupling means for causing a fifth mutual coupling of energy between said parallel second resonances of said first and second resonators;

mode coupling means for causing a sixth mutual coupling of energy between said parallel first resonances of said second and third resonators;

mode coupling means for causing a seventh mutual coupling of energy between said parallel second resonances of said second and third resonators;

input means for coupling microwave energy into at least one of said resonances of said first resonator;

output means for coupling a portion of said microwave energy out of at least one of said resonances of said third resonator;

wherein the magnitudes of said fourth and fifth mutual couplings are approximately equal and the magnitudes of said sixth and seventh mutual couplings are approximately equal.

23. The filter of claim 22, wherein said microwave dual-mode resonators are dual-mode dielectric resonators, each comprising a shared conductive enclosure with high dielectric constant, high Q ceramic material disposed within said enclosure.

24. The filter of claim 23, wherein said resonance modes are $HEH_{11}$ dual hybrid modes.

25. The filter of claim 22, wherein at least some of said mode coupling means include tuning means for controllably and adjustably coupling said resonances.

26. The filter of claim 22, wherein said input means comprises a probe fixed to and penetrating into said shared conductive enclosure and principally coupling to said first resonance of said first resonator.

27. The filter of claim 22, wherein said output means comprises a probe fixed to and penetrating into said shared conductive enclosure and principally coupling to said second resonance of said third resonator.

28. The filter of claim 22, wherein said shared conductive enclosure is a circular cross-section cut-off waveguide cylinder.

* * * * *

UNITED STATES PATENT AND TRADEMARK OFFICE

CERTIFICATE OF CORRECTION

PATENT NO. : 5,576,674

DATED : 3/1/95

INVENTOR(S) : DOUGLAS R. JACHOWSKI

It is certified that error appears in the above-indentified patent and that said Letters Patent is hereby corrected as shown below:

Col. 13, line 22, the dash ("-") should not appear between "as is" and "required";

Col. 9, line 63, claim 2, where the subscript letter "u" appears, the letter "i" should appear instead.

Signed and Sealed this

Fourth Day of March, 1997

Bruce Lehman

*Attest:*

BRUCE LEHMAN

*Attesting Officer*

*Commissioner of Patents and Trademarks*